US011617482B2

(12) United States Patent
Sardar et al.

(10) Patent No.: US 11,617,482 B2
(45) Date of Patent: Apr. 4, 2023

(54) ACCESSORIES FOR A SURFACE TREATMENT APPARATUS HAVING A PLURALITY OF OPERATIONAL STATES AND SURFACE TREATMENT APPARATUS CONFIGURED TO ACTUATE THE SAME

(71) Applicant: SharkNinja Operating, LLC, Needham, MA (US)

(72) Inventors: Nicholas Sardar, London (GB); Christopher P. Pinches, Surrey (GB); Lee M. Cottrell, Newton, MA (US); Samuel Emrys James, London (GB); Michael James Douglas, London (GB); David S. Clare, London (GB)

(73) Assignee: SharkNinja Operating LLC, Needham, MA (US)

( * ) Notice: Subject to any disclaimer, the term of this patent is extended or adjusted under 35 U.S.C. 154(b) by 971 days.

(21) Appl. No.: 16/270,078

(22) Filed: Feb. 7, 2019

(65) Prior Publication Data

US 2019/0246853 A1 Aug. 15, 2019

Related U.S. Application Data

(60) Provisional application No. 62/712,634, filed on Jul. 31, 2018, provisional application No. 62/628,781, filed on Feb. 9, 2018.

(51) Int. Cl.

| | |
|---|---|
| ***A47L 9/00*** | (2006.01) |
| ***A47L 9/32*** | (2006.01) |
| ***A46B 15/00*** | (2006.01) |

(52) U.S. Cl.
CPC ..... *A47L 9/0027* (2013.01); *A46B 15/0095* (2013.01); *A47L 9/322* (2013.01)

(58) Field of Classification Search
CPC ..... A46B 15/0095; A47L 5/24; A47L 9/0027; A47L 9/0063; A47L 9/242; A47L 9/248; A47L 9/30; A47L 9/322
See application file for complete search history.

(56) References Cited

U.S. PATENT DOCUMENTS 5,389,004 A * 2/1995 Gray ..... A47L 9/242 439/191
6,530,118 B2 3/2003 Oh
(Continued)

FOREIGN PATENT DOCUMENTS

CN 2549882 5/2003
CN 2549882 Y * 5/2003
(Continued)

OTHER PUBLICATIONS

PCT Search Report and Written Opinion dated Apr. 26, 2019, received in corresponding PCT Application No. PCT/US19/17030, 9 pgs.
(Continued)

*Primary Examiner* — Marc Carlson
(74) *Attorney, Agent, or Firm* — Grossman Tucker Perreault & Pfleger, PLLC

(57) ABSTRACT

A surface treatment apparatus may include a coupling, a handle, an accessory coupled to the coupling, and a toggle proximate the handle. The accessory may have at least two operational states. An actuation of the toggle may cause the accessory to transition between operational states.

17 Claims, 29 Drawing Sheets

(56) References Cited

U.S. PATENT DOCUMENTS

| | | | | |
|---|---|---|---|---|
| 7,377,007 | B2 | 5/2008 | Best | |
| 8,826,490 | B1 * | 9/2014 | Giarmo | A47L 11/4075 15/323 |
| 8,943,647 | B1 | 2/2015 | Henderson | |
| D740,506 | S | 10/2015 | Yoon | |
| D743,649 | S | 11/2015 | Yoon et al. | |
| D745,232 | S | 12/2015 | Yoon et al. | |
| 10,638,901 | B2 | 5/2020 | Yang et al. | |
| 10,986,972 | B2 | 4/2021 | Jenson | |
| 11,045,062 | B2 * | 6/2021 | Innes | A47L 13/26 |
| 2002/0101075 | A1 | 8/2002 | Park et al. | |
| 2004/0223803 | A1 * | 11/2004 | Fahy | A47L 13/22 401/190 |
| 2008/0031678 | A1 | 2/2008 | Gansebom et al. | |
| 2012/0042471 | A1 * | 2/2012 | Spiggle | A47L 9/242 15/347 |
| 2013/0255029 | A1 | 10/2013 | Wolfe, Jr. et al. | |
| 2014/0338146 | A1 * | 11/2014 | Lee | A47L 9/0653 15/323 |
| 2014/0338148 | A1 * | 11/2014 | Lee | A47L 9/0673 15/400 |
| 2016/0208981 | A1 * | 7/2016 | Kaesemeyer | B05B 9/007 |
| 2016/0235267 | A1 | 8/2016 | Han et al. | |
| 2016/0270614 | A1 | 9/2016 | Kawamura et al. | |
| 2016/0270615 | A1 * | 9/2016 | Kawamura | A47L 9/1641 |
| 2017/0196425 | A1 | 7/2017 | Brown et al. | |
| 2017/0340182 | A1 | 11/2017 | Caruso | |
| 2018/0055313 | A1 | 3/2018 | Yang et al. | |
| 2018/0132683 | A1 * | 5/2018 | Walker | A47L 9/0036 |
| 2018/0177368 | A1 | 6/2018 | Acker et al. | |
| 2019/0357741 | A1 | 11/2019 | Conrad | |
| 2021/0345848 | A1 * | 11/2021 | Jeon | A47L 9/2873 |

FOREIGN PATENT DOCUMENTS

| | | | |
|---|---|---|---|
| CN | 108113571 | A | 6/2018 |
| CN | 207444893 | | 6/2018 |
| DE | 102008034458 | | 1/2010 |
| EP | 1908386 | | 4/2008 |
| EP | 2100546 | A1 | 9/2009 |
| JP | 2007301260 | | 11/2007 |
| JP | 2010194070 | A | 9/2010 |
| JP | 2013162882 | A | 8/2013 |
| JP | 2019030554 | | 2/2019 |

OTHER PUBLICATIONS

Chinese Office Action with English translation dated Jun. 2, 2021, received in Chinese Patent Application No. 201980020798.7, 11 pages.

PCT Search Report and Written Opinion dated Oct. 25, 2019, received in PCT Application No. PCT/US19/44483, 9 pgs.

Chinese Office Action with English translation dated Sep. 13, 2021, received in Chinese Patent Application No. 201980062711.2, 11 pages.

U.S. Office Action dated Nov. 3, 2021, received in U.S. Appl. No. 16/528,212, 21 pages.

European Extended Search Report dated Feb. 10, 2022, received in European Patent Application No. 19750309.7, 10 pages.

Chinese Office Action with English translation dated Mar. 2, 2022, received in Chinese Patent Application No. 201980020798.7, 5 pages.

Australian Examination Report dated Mar. 3, 2022, received in Australian Patent Application No. 2019312591, 3 pages.

European Extended Search Report dated May 10, 2022, received in European Patent Application No. 19845568.5, 8 pages.

Canadian Examiner Report dated Jun. 23, 2022, received in Canadian Patent Application No. 3,112,975, 4 pages.

* cited by examiner

ACCESSORIES FOR A SURFACE TREATMENT APPARATUS HAVING A PLURALITY OF OPERATIONAL STATES AND SURFACE TREATMENT APPARATUS CONFIGURED TO ACTUATE THE SAME

CROSS-REFERENCE TO RELATED APPLICATIONS

The present application claims the benefit of U.S. Provisional Application Ser. No. 62/628,781, filed on Feb. 9, 2018, entitled Accessories for a Surface Treatment Apparatus having a Plurality of Operational States and U.S. Provisional Application Ser. No. 62/712,634 filed on Jul. 31, 2018, entitled Upright Surface Treatment Apparatus having Removable Pod, both of which are fully incorporated herein by reference.

FIELD

The present disclosure is generally directed to accessories for a surface treatment apparatus and more specifically to accessories having a plurality of operational states.

BACKGROUND

Surface treatment apparatus (e.g., vacuum cleaners) may include multiple accessories capable of improving the performance and/or usability of the surface treatment apparatus when conducting a specific cleaning operation. For example, a vacuum cleaner may include a brush attachment, a crevice attachment, a wand, and/or any other accessory. In some cases, each accessory is coupled to the surface treatment apparatus such that an operator can interchange accessories during operation of the surface cleaning apparatus. However, as the number of accessories increases, it may become more difficult to store the accessories on the surface treatment apparatus.

BRIEF DESCRIPTION OF THE DRAWINGS

Features and advantages of the claimed subject matter will be apparent from the following detailed description of embodiments consistent therewith, which description should be considered with reference to the accompanying drawings, wherein:

DETAILED DESCRIPTION

The present disclosure is generally directed to a surface treatment apparatus capable of being coupled to one or more accessories, each having at least two operational states. The surface treatment apparatus may include a toggle (e.g., a trigger or a button) that, when actuated, causes an accessory coupled to the surface treatment apparatus to transition between operational states. By positioning the toggle on the surface treatment apparatus (instead of, for example, on the accessory) an operator is able to change the operational state of the accessory without having to directly manipulate (e.g., touch) the accessory. In some instances, this may prevent an operator from having to bend over and directly manipulate the accessory. Further, by utilizing accessories having at least two operational states, it may be possible to carry fewer accessories without having to sacrifice functionality.

Figure 1:
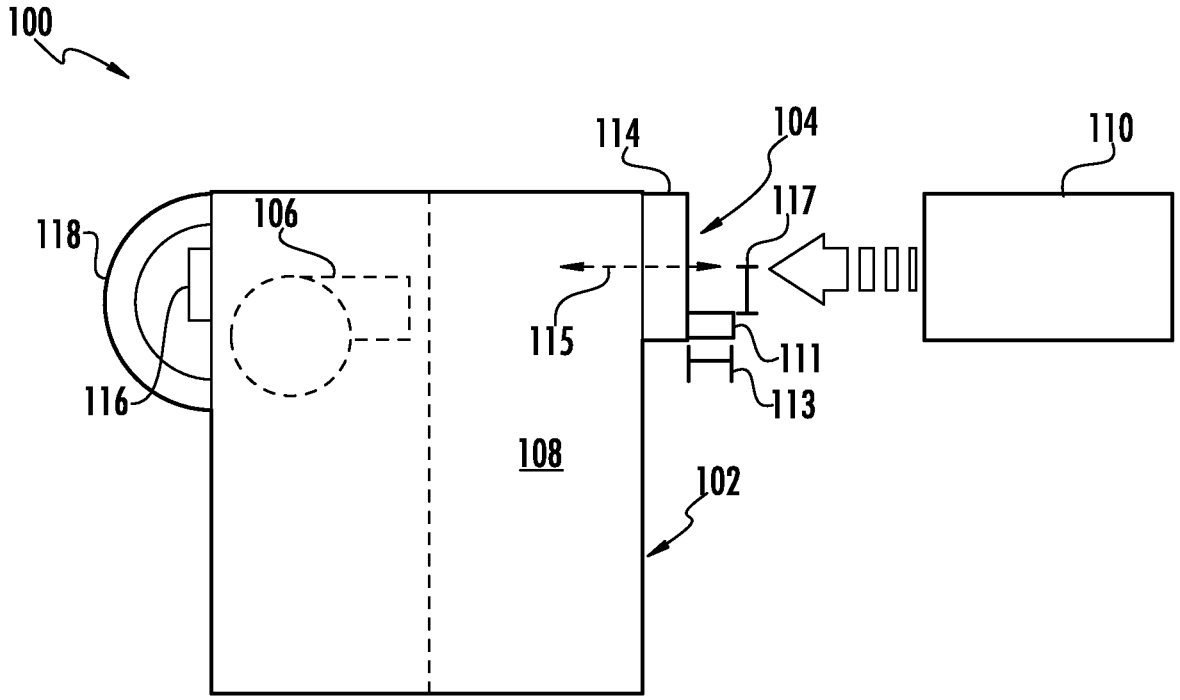
FIG. 1 is a schematic view of an example of a surface treatment apparatus, consistent with embodiments of the present disclosure.

FIG. 1 shows an example of a surface treatment apparatus 100. The surface treatment apparatus 100 includes a vacuum chamber 102 fluidly coupled to an inlet 104. The vacuum chamber 102 includes a suction motor 106 and a debris canister 108. The suction motor 106 draws air carrying debris (e.g., dust) through the inlet 104 into the debris canister 108. When the air enters the debris canister 108, at least a portion of the debris entrained within the air is deposited in the debris canister 108. The remaining air is then expelled from the vacuum chamber 102 via an air outlet.

A coupling 114 is provided proximate the inlet 104 (e.g., the coupling 114 may extend around at least a portion of the inlet 104) and is configured to couple to, for example, an accessory 110. As shown, an actuator 111 is proximate the coupling (e.g., the coupling 114 may include the actuator 111), which is configured to engage at least a portion of the accessory 110, when coupled to the coupling 114. The actuator 111 transitions between a first state and a second state in response to the actuation of a toggle 116 (e.g., a button or a trigger). The movement of the actuator 111 causes a corresponding movement in the accessory 110. For example, movement of the actuator 111 may cause the accessory 110 to transition from a first operational state to a second operational state such that the performance of the accessory 110 may be changed. Therefore, the accessory 110 may generally be described as transitioning between operational states in response to the actuation of the toggle 116.

The actuator 111 may be positioned at any location relative to the coupling 114. When in an unactuated state, the actuator 111 may extend from the coupling 114 by an extension distance 113 that measures in a range of, for example, 0 millimeters (mm) to 20 mm. In some instances, when in the unactuated state, the actuator 111 may be recessed relative to the coupling 114. When in an actuated state, the extension distance 113 may measure in a range of, for example, 10 mm to 40 mm. The actuator 111 may be spaced apart from a central axis 115 of the inlet 104 by a separation distance 117 measuring in a range of, for example, 10 mm to 40 mm. A maximum width of the actuator 111 may measure in a range of, for example, 1 mm to 20 mm.

The toggle 116 may be configured as latching or non-latching. When the toggle 116 is latching the accessory 110 only transitions between operational states when the toggle 116 is transitioned from a first state (e.g., a first position) to a second state (e.g., a second position). When the toggle 116 is configured as non-latching, the accessory 110 transitions between operational states in response to the toggle 116 transitioning from the first state and the second state and from the second state to the first state.

As shown, the toggle 116 is proximate a handle 118 (e.g., the handle 118 may be on an opposing side of the vacuum chamber 102 relative to the inlet 104). For example, the toggle 116 may be coupled to the handle 118 and/or the vacuum chamber 102. As such, an operator of the surface treatment apparatus 100 is able to change an operational state of the accessory 110 without having to directly manipulate (e.g., touch) the accessory 110. In some instances, a plurality of accessories 110, each having at least two operational states, are configured to cooperate with the coupling 114 and the actuator 111.

The accessory 110 may include, for example, a crevice tool, a brush, and/or a wand. As will be discussed further herein, the accessory 110 has at least two operational states. This may allow a single accessory to perform multiple functions, allowing an operator of the surface treatment apparatus 100 to carry fewer accessories to perform a given cleaning task. In some instances, a plurality of accessories may be coupled to the surface treatment apparatus 100. For example, a wand may fluidly couple a crevice tool to the surface treatment apparatus 100, wherein at least one of the wand or the crevice tool have a plurality of operational states.

Figure 2:
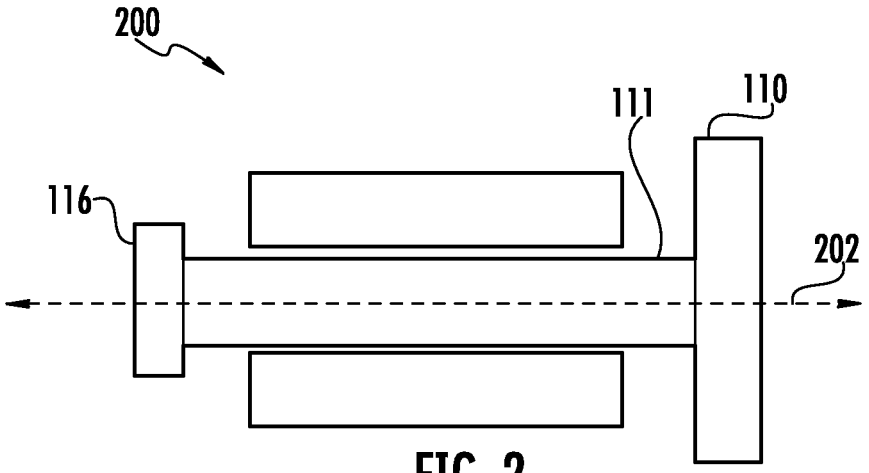
FIG. 2 is a cross-sectional schematic view of a toggle assembly capable of being used with the surface treatment apparatus of FIG. 1 to transition an accessory between at least a first and second operational state, consistent with embodiments of the present disclosure.

FIG. 2 shows a cross-sectional schematic example of a toggle assembly 200 engaging at least a portion of the accessory 110. As shown, the toggle assembly 200 includes the toggle 116 and the actuator 111. The actuator 111 extends from the toggle 116 in a direction of the accessory 110. Actuation of the toggle 116 causes the actuator 111 to move along an actuation axis 202 (e.g., a longitudinal axis) in a direction towards or away from the accessory 110. Movement of the actuator 111 along the actuation axis 202 causes a corresponding movement in the accessory 110 such that the accessory 110 transitions between the first and second operational states. For example, the accessory 110 may include a moveable component that moves in response to movement of the actuator 111 along the actuation axis 202. The movement of the moveable component may cause the accessory 110 to transition between first and second operational states.

Figure 3:
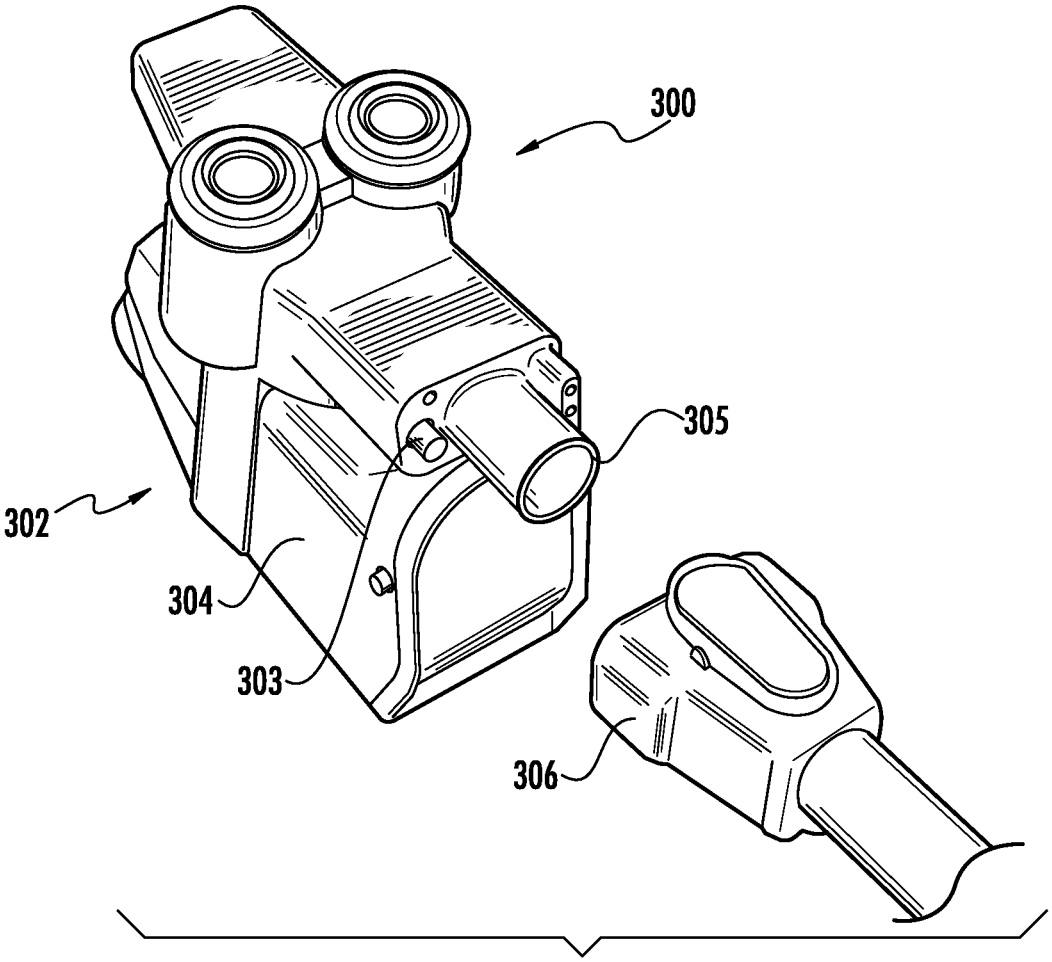
FIG. 3 is a perspective view of a handheld surface treatment apparatus, consistent with embodiments of the present disclosure.

FIG. 3 shows an example of a handheld surface cleaning apparatus 300, which may be an example of the surface treatment apparatus 100 of FIG. 1. As shown, the handheld surface cleaning apparatus 300 includes a vacuum chamber 302 having a debris canister 304 and an actuator 303 capable of movement between a first and second state. An accessory 306, which may be an example of the accessory 110 of FIG. 1, is coupled to the vacuum chamber 302 at a coupling 305 such that air can be drawn from an inlet of the accessory 306 into the debris canister 304. In some instances, the accessory 306 is directly coupled to the coupling 305. In other instances, the accessory 306 is not directly coupled to the coupling 305. For example, a wand may be disposed between the accessory 306 and the coupling 305. In these instances, the wand and/or the accessory 306 may have two or more operational states.

Figure 4A:
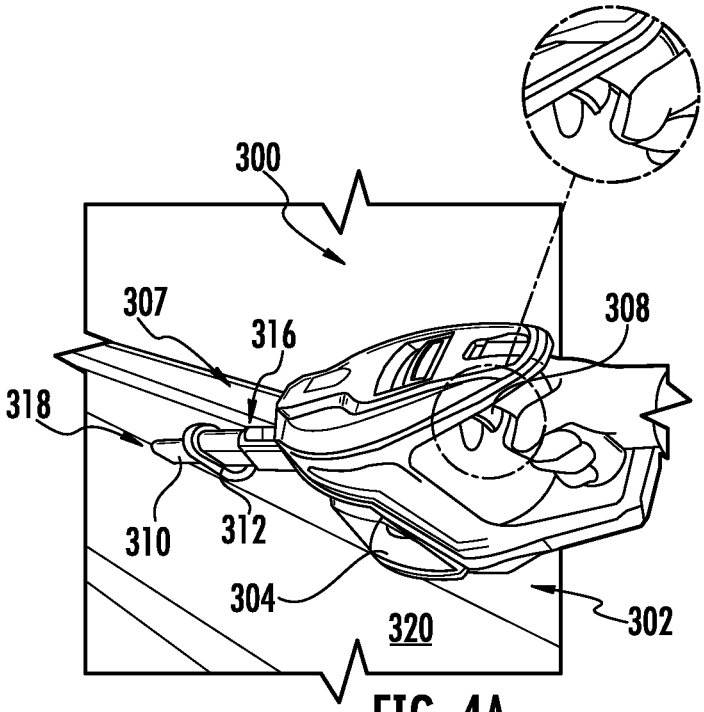
FIG. 4A is a perspective view of an example of the handheld surface treatment apparatus of FIG. 3 having an accessory in a first state, consistent with embodiments of the present disclosure.
Figure 4B:
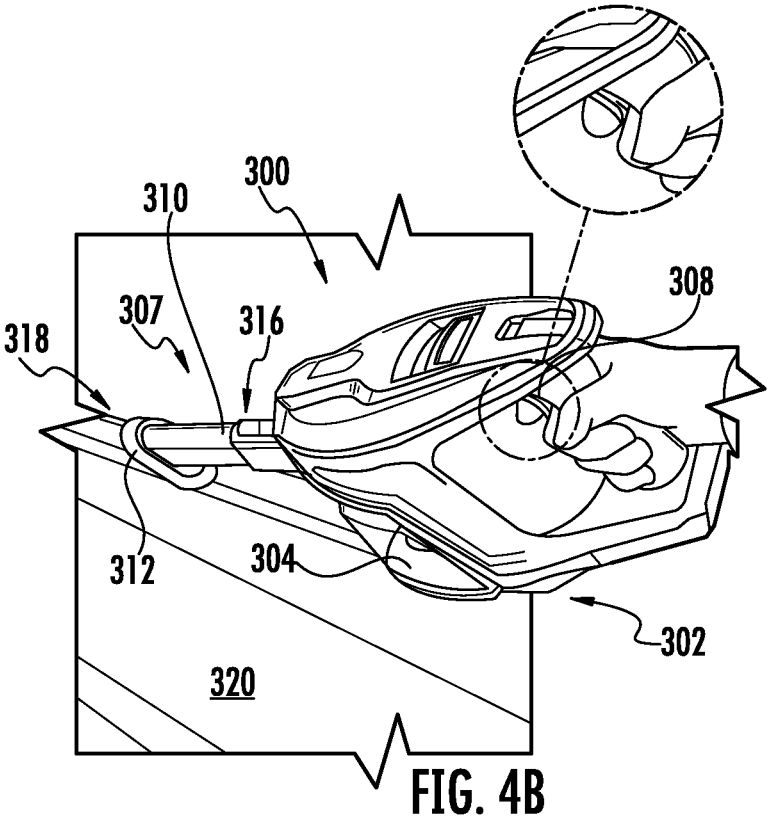
FIG. 4B is another perspective view of the handheld surface treatment apparatus of FIG. 4A having an accessory in a second state, consistent with embodiments of the present disclosure.

FIGS. 4A and 4B show an example of the handheld surface cleaning apparatus 300. As shown, the handheld surface cleaning apparatus 300 can include a toggle 308 (e.g., a depressible button or a trigger). For purposes of clarity the toggle 308 is illustrated in FIGS. 4A and 4B as a trigger, however, the toggle 308 may also be, for example, a button configured to be depressed. The toggle 308 may be actuated between a first state (e.g., as shown in FIG. 4A) and a second state (e.g., as shown in FIG. 4B). Actuation of the toggle 308 causes a corresponding movement of the actuator 303. The actuator 303 may engage (e.g., contact) at least a portion of an accessory 307. The accessory 307 can be configured to transition between operation states (e.g., between a crevice tool 310 and a brush tool 312). The accessory 307 may be an example of the accessory 110 of FIG. 1. In some instances, the actuator 303 may engage (e.g., contact) at least a portion of an intermediary accessory extending between the accessory 307 and the actuator 303. In these instances, the intermediary accessory may also have a plurality of operational states.

The toggle 308 may generally be described as being either latching or non-latching. When the toggle 308 is latching, the accessory 307 transitions between the brush tool 312 and the crevice tool 310 only when the toggle is transitioned, for example, from the first state to the second state. When the toggle 308 is non-latching, the accessory 307 transitions between the brush tool 312 and the crevice tool 310 when the toggle 308 is transitioned, for example, from the first state to the second state and from the second state to the first state.

The accessory 307 is capable of transitioning between a crevice tool 310 and a brush tool 312 in response to the actuation of the toggle 308. As shown, the brush tool 312 slideably engages the crevice tool 310 such that the brush tool 312 is capable of transitioning between a first state (e.g., a stored state) and second state (e.g., a use state). For example, in response to actuating the toggle 308, the brush tool 312 slides along the crevice tool 310 from a proximal end 316 (e.g., an end closest an operator of the handheld surface cleaning apparatus 300) of the crevice tool 310 to a distal end 318 (e.g., an end closest to a surface to be cleaned) of the crevice tool 310 such that the brush tool 312 is capable of engaging (e.g., contacting) a surface 320 (e.g., a floor).

Figure 5:
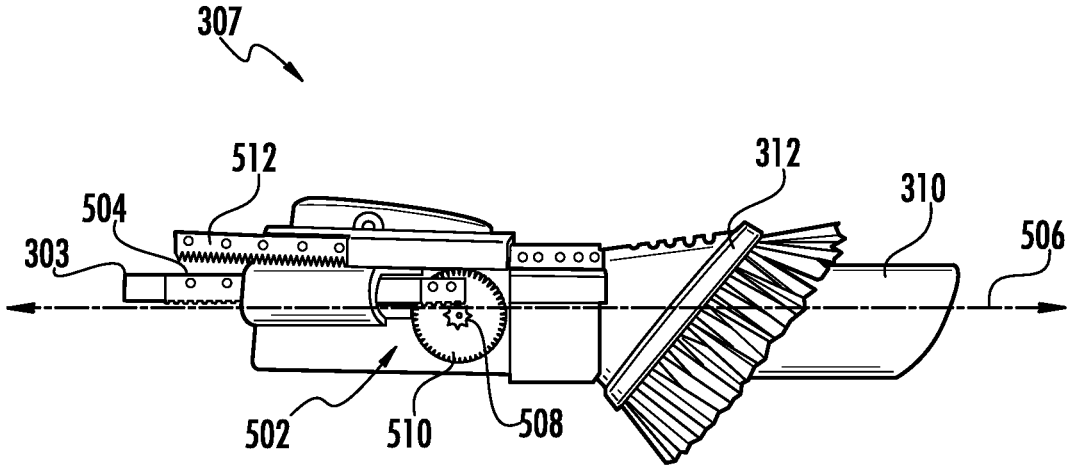
FIG. 5 is a side view of an example of the accessory of FIG. 4A in a first state, consistent with embodiments of the present disclosure.
Figure 6:
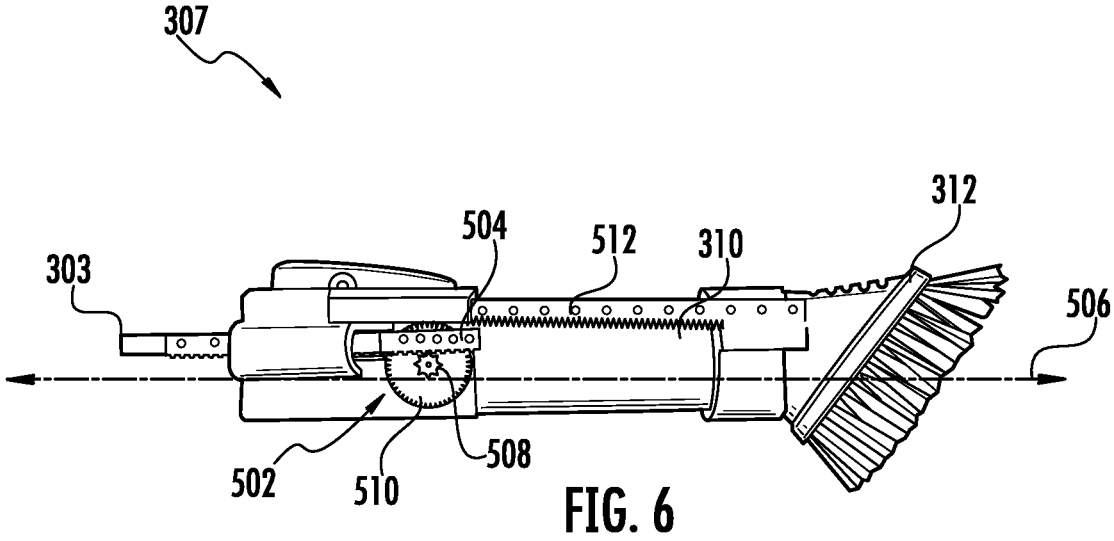
FIG. 6 is a side view of an example of the accessory of FIG. 5 in a second state, consistent with embodiments of the present disclosure.

FIGS. 5 and 6 show an example of the accessory 307 of FIGS. 4A and 4B. As shown, the accessory 307 includes a rack and pinion system 502. The rack and pinion system 502 includes a first rack 504 that moves along a longitudinal axis 506 of the accessory 307 in response to the toggle 308 being transitioned, for example, from the first state to the second state. For example, when the toggle 308 is transitioned from the first state to the second state, the toggle 308 may cause the actuator 303 to move along the longitudinal axis 506 such that the actuator 303 engages (e.g., contacts) the first rack 504, causing the first rack 504 to move. In some instances, the actuator 303 is detachably coupled to the first rack 504 such that the accessory 307 can be removed from the handheld surface cleaning apparatus 300. Additionally, or alternatively, a biasing mechanism may be provided that urges the first rack 504 in a direction of the actuator 303. The biasing mechanism may be, for example, a spring (e.g., a tension spring, a torsion spring, a compression spring, and/or any other suitable spring), an elastic material (e.g., a rubber), and/or any other suitable biasing mechanism.

As the first rack 504 moves along the longitudinal axis 506, the first rack 504 causes a first pinion 508 to rotate. The rotation of the first pinion 508 results in a corresponding rotation of a second pinion 510. The rotation of the second pinion 510 causes a second rack 512 to move along the longitudinal axis 506. The movement of the second rack 512 causes the brush tool 312 to slide along the crevice tool 310. Therefore, the second rack 512 is coupled to the brush tool 312 such that the brush tool 312 moves with the second rack 512.

As shown, the first pinion 508 has a diameter that measures less than a diameter of the second pinion 510. In some instances, the first and second pinions 508 and 510 form a unitary body. In other instances, the first and second pinions 508 and 510 are coupled to each other using, for example, an adhesive, a press-fit, a snap-fit, a threaded fastener (e.g., a bolt or a screw), and/or any other suitable form of coupling.

Figure 7:
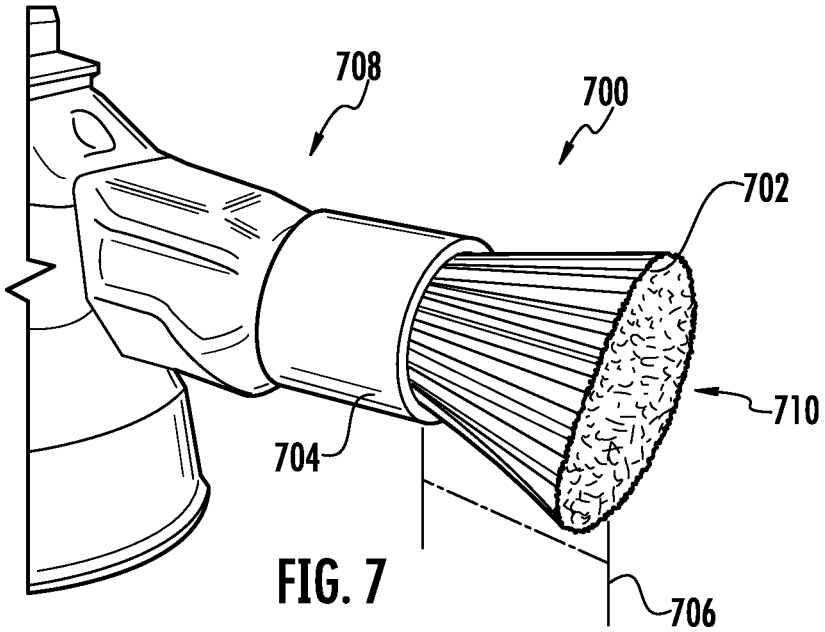
FIG. 7 is a perspective view of an accessory in a first state, the accessory having a brush extending from a collar, consistent with embodiments of the present disclosure.
Figure 8:
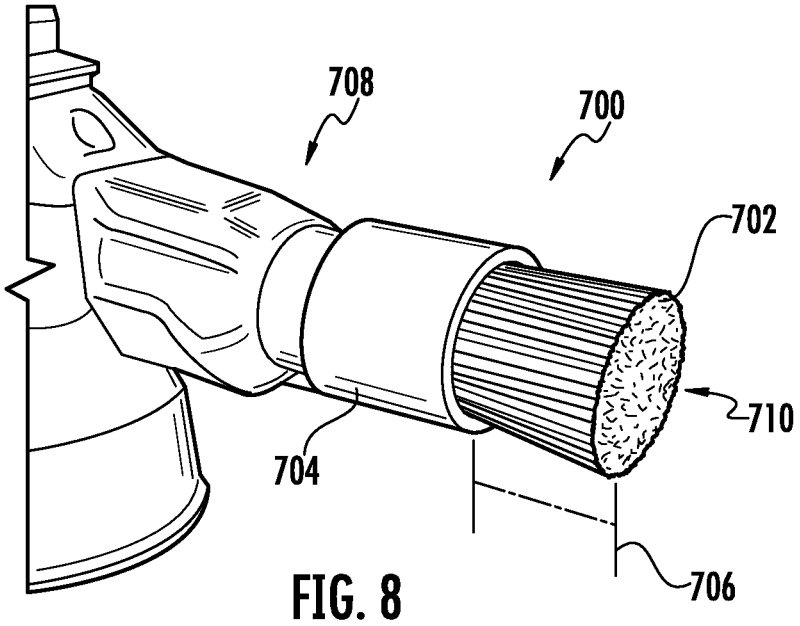
FIG. 8 is another perspective view of the accessory of FIG. 7, wherein the accessory is in a second state, consistent with embodiments of the present disclosure.

FIGS. 7 and 8 show an accessory 700, which may be an example of the accessory 110 of FIG. 1, having a brush 702 extending from a collar 704. The collar 704 is adjustable relative to the brush 702 such that a length 706 of the brush 702 extending from the collar 704 can be adjusted. As the length 706 of the brush 702 extending from the collar 704 decreases, the stiffness of the brush 702 increases. Conversely, as the length 706 of the brush 702 increases, the stiffness of the brush 702 decreases.

In some instances, the collar 704 slides along the brush 702 in response to the actuation of the toggle 308, which may be either latching or non-latching. For example, when the toggle 308 is transitioned from the first state to the second state, the collar 704 transitions from a first state (e.g., as shown in FIG. 7) to a second state (e.g., as shown in FIG. 8). In other words, the collar 704 slides from a proximal end 708 (e.g., an end closest an operator of the handheld surface cleaning apparatus 300) of the brush 702 to a distal end 710 of the brush 702 (e.g., an end closest to a surface to be cleaned). As the collar 704 approaches the distal end 710 of the brush 702, the length 706 of the brush 702 extending from the collar 704 decreases, increasing the stiffness of the brush 702.

Figure 9:
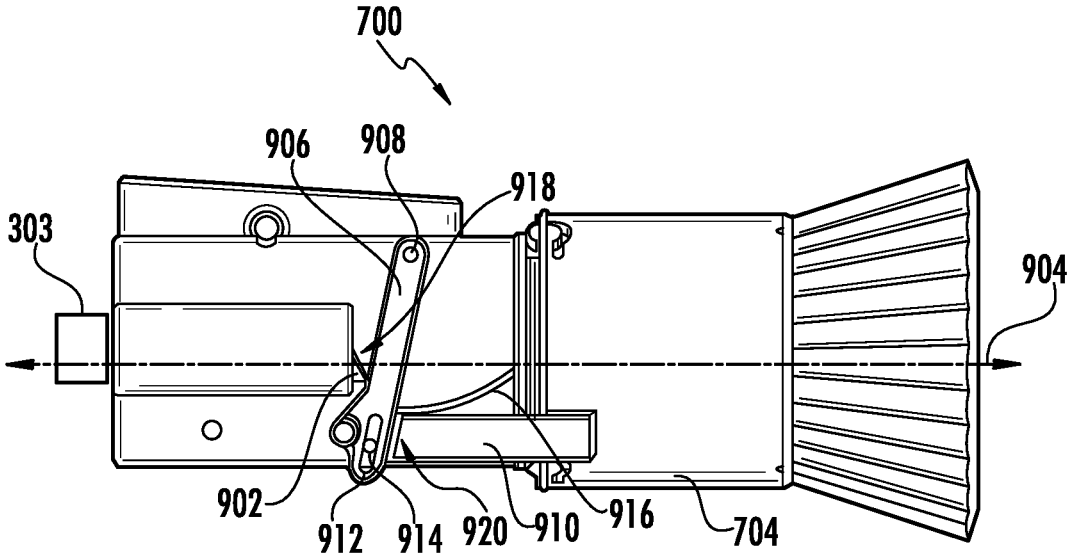
FIG. 9 shows a cross-sectional view of an example of the accessory of FIG. 7, consistent with embodiments of the present disclosure.
Figure 10:
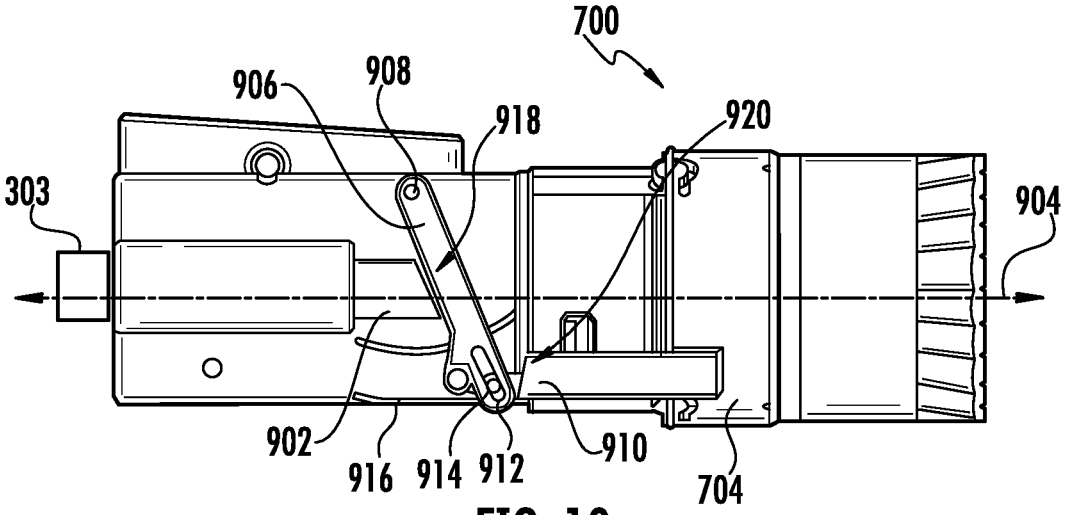
FIG. 10 shows a cross-sectional view of an example of the accessory of FIG. 8, consistent with embodiments of the present disclosure.

FIGS. 9 and 10 show a cross-sectional view of an example of the accessory 700 of FIGS. 7 and 8. As shown, the collar 704 transitions from a first state (e.g., as shown in FIG. 9) to a second state (e.g., as shown in FIG. 10) in response to a plunger 902 moving along a longitudinal axis 904 of the accessory 700. Movement of the plunger 902 along the longitudinal axis 904 causes a pivot arm 906 to pivot about a pivot point 908 such that the pivotal movement causes a corresponding movement of a translational arm 910 along the longitudinal axis 904. As shown, the translational arm 910 is coupled to the collar 704 such that movement of the translational arm 910 along the longitudinal axis 904 causes a corresponding movement of the collar 704 along the longitudinal axis 904.

As also shown, the translational arm 910 is coupled to the pivot arm 906. For example, the pivot arm 906 may include a slot 912 for receiving a corresponding protrusion 914 extending from the translational arm 910. As the pivot arm 906 pivots about the pivot point 908, the protrusion 914 slides within the slot 912. In some instances, a portion of the pivot arm 906 is received within a track 916. The track 916 may guide the pivot arm 906 as the pivot arm 906 pivots about the pivot point 908.

In some instances, when the collar 704 is in the first state, an engagement surface 918 of the plunger 902 is transverse to the pivot arm 906 and an engagement surface 920 of the translational arm 910 is substantially parallel to the pivot arm 906. When the collar 704 is in the second state, the engagement surface 918 of the plunger 902 may be substantially parallel to the pivot arm 906 and the engagement surface 920 of the translational arm 910 may be transverse to the pivot arm 906. The engagement surfaces 918 and 920 are configured to at least partially engage at least a portion of the pivot arm 906 in response to actuation of the toggle 308.

The plunger 902 may engage (e.g., contact) the actuator 303 of the handheld surface cleaning apparatus 300. The actuator 303 is configured to move along the longitudinal axis 904 in response to, for example, the toggle 308 transitioning from the first state to the second state. As the actuator 303 moves, the actuator 303 causes the plunger 902 to move. In some instances, the plunger 902 may be coupled to the actuator 303 using, for example, an adhesive, a press-fit, a snap-fit, a threaded fastener (e.g., a bolt or a screw), and/or any other suitable form of coupling. In some instances, the actuator 303 is detachably coupled to the plunger 902 such that the accessory 700 can be removed from the handheld surface cleaning apparatus 300. In some instances, a biasing mechanism may be provided that urges the plunger 902 in a direction of the actuator 303. The biasing mechanism may be, for example, a spring (e.g., a tension spring, a torsion spring, a compression spring, and/or any other suitable spring), an elastic material (e.g., a rubber), and/or any other suitable biasing mechanism. In some instances, the accessory 700 may not include the plunger 902 and the actuator 303 may engage (e.g., contact) the pivot arm 906.

Figure 11:
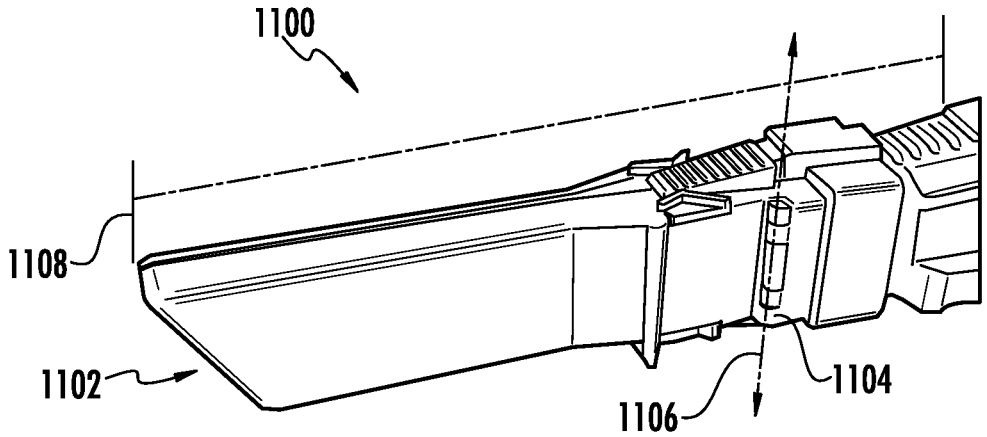
FIG. 11 is a perspective view of an example of a crevice tool accessory, consistent with embodiments of the present disclosure.
Figure 12:
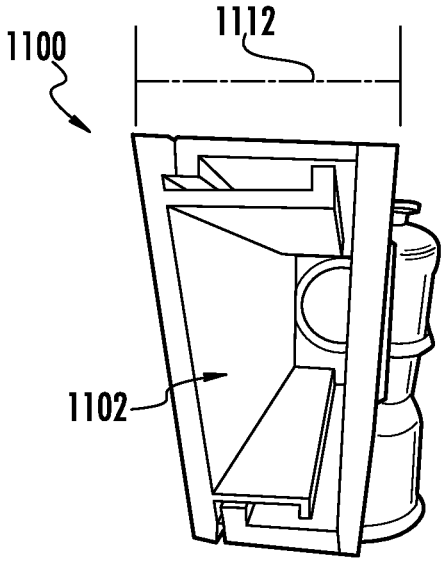
FIG. 12 is an end view of the crevice tool accessory of FIG. 11 in a first state, consistent with embodiments of the present disclosure.
Figure 13:
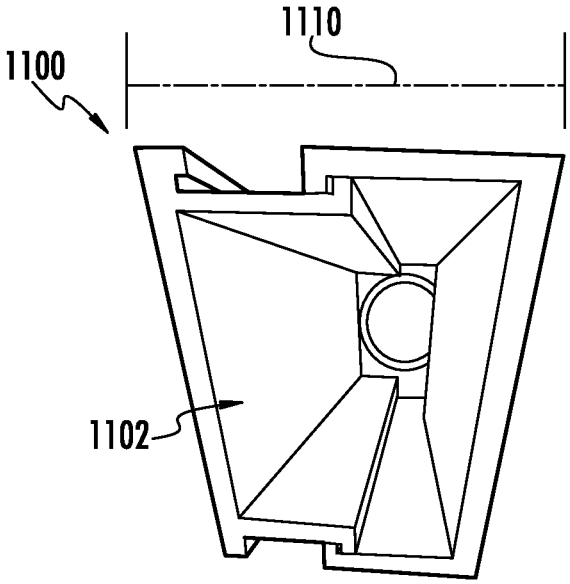
FIG. 13 is an end view of the crevice tool accessory of FIG. 11 in a second state, consistent with embodiments of the present disclosure.

FIGS. 11-13 show an example of a crevice tool accessory 1100, which may be an example of the accessory 110 of FIG. 1. As shown, the crevice tool accessory 1100 transitions between a first state (e.g., as shown in FIG. 12) and a second state (e.g., as shown in FIG. 13). The crevice tool accessory 1100 transitions from the first state to the second state in response to, for example, the actuation of the toggle 308, which may be either latching or non-latching. As the crevice tool accessory 1100 transitions from the first state to the second state an inlet 1102 to the crevice tool accessory 1100 expands from an unexpanded width 1112 to an expanded width 1110. As such, it may become easier for larger debris to be drawn into the crevice tool accessory 1100.

A ratio of a measure of the expanded width 1110 to a measure of the unexpanded width 1112 may be, for example, in a range of 4:3 to 5:1. By way of further example, a ratio of a measure of the expanded width 1110 to a measure of the unexpanded width 1112 may be in a range of 3:2 to 3:1. By way of even further example, a ratio of a measure of the expanded width 1110 to a measure of the unexpanded width 1112 may be 2:1.

In some instances, the crevice tool accessory 1100 includes a hinge 1104 such that at least a portion of the crevice tool accessory 1100 pivots about a pivot axis 1106 of the hinge 1104. By pivoting the crevice tool accessory 1100 about the pivot axis 1106, a length 1108 of the crevice tool accessory 1100 may be reduced. When the length 1108 is reduced, the crevice tool accessory 1100 may expose a secondary air inlet such that debris may still be drawn into the crevice tool accessory 1100. In some instances, when the length 1108 is reduced, an additional accessory may be coupled to the crevice tool accessory 1100.

Figure 16:
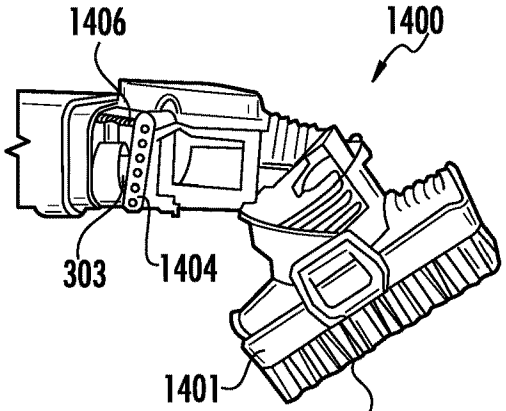
FIG. 16 is a perspective view of the accessory of FIG. 14 in the second state, consistent with embodiments of the present disclosure.
Figure 15:
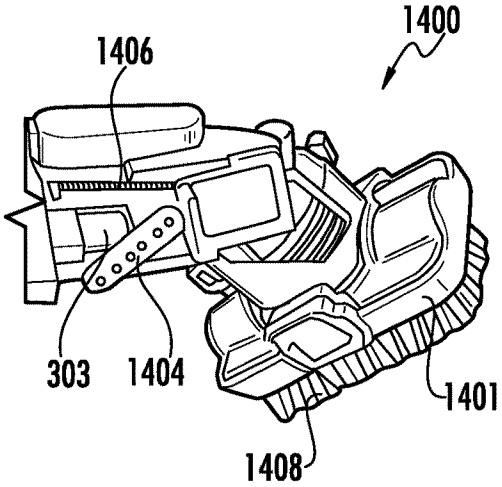
FIG. 15 is a perspective view of the accessory of FIG. 14 transitioning from the first state to a second state, consistent with embodiments of the present disclosure.
Figure 14:
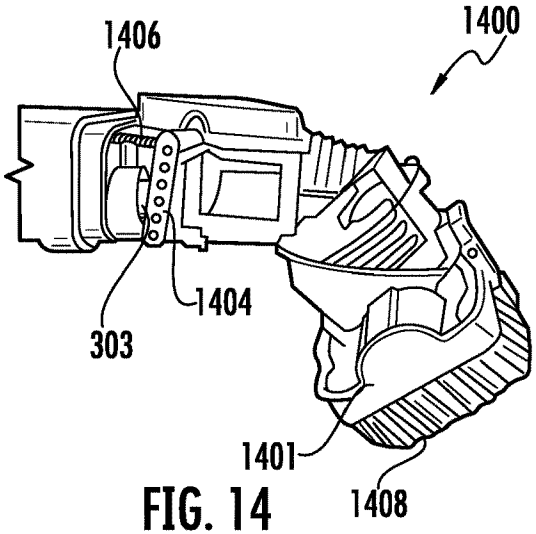
FIG. 14 is a perspective view of an accessory having a rotatable cleaning head in a first state, consistent with embodiments of the present disclosure.

FIGS. 14-18 show perspective views of an accessory 1400, which may be an example of the accessory 110 of FIG. 1. The accessory 1400 includes a cleaning head 1401 having bristles 1408. The cleaning head 1401 may be capable of rotation in response to the actuation of, for example, the toggle 308 from the first state to the second state. The toggle 308 may be latching or non-latching. FIG. 14 shows the accessory 1400 in a first state, FIG. 15 shows the accessory 1400 transitioning from the first to a second state, and FIG. 16 shows the accessory 1400 in the second state. As shown, in FIG. 15, when the toggle 308 is transitioned from, for example, the first state to the second state, the actuator 303 engages a pivot arm 1404 such that, as the pivot arm 1404 pivots, the cleaning head 1401 rotates. The pivot arm 1404 may be coupled to a biasing mechanism 1406 such that the pivot arm 1404 is urged in a direction of the actuator 303. The biasing mechanism 1406 may be, for example, a spring (e.g., a tension spring, a torsion spring, a compression spring, and/or any other suitable spring), an elastic material (e.g., a rubber), and/or any other suitable biasing mechanism.

In some instances, the cleaning head 1401 rotates only in the clockwise direction or only in the counter-clockwise direction. For example, each time the toggle 308 is transitioned from the first state to the second state, the cleaning head 1401 rotates a predetermined distance in only one of the clockwise direction or the counter-clockwise direction (e.g., 45°, 90°, 120°, and/or any other suitable rotation angle). In other instances, the cleaning head 1401 rotates in both the clockwise direction and the counter-clockwise direction.

Figure 17:
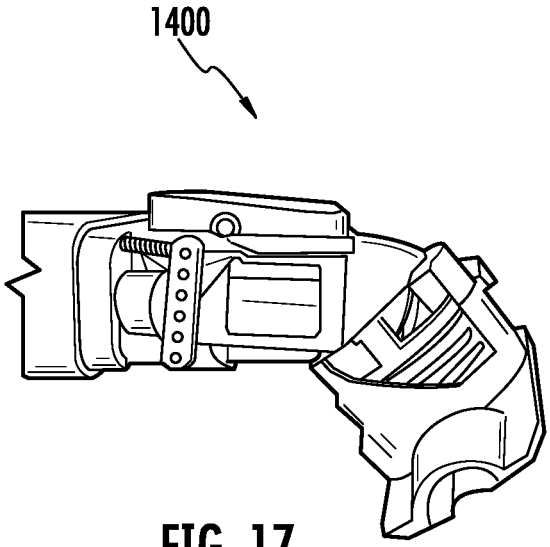
FIG. 17 is a perspective view of the accessory of FIG. 14 configured to receive a removable cleaning head, consistent with embodiments of the present disclosure.
Figure 18:
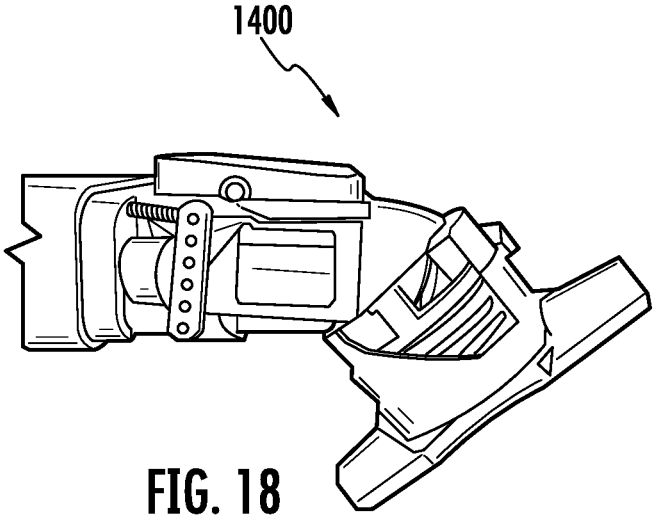
FIG. 18 is a perspective view of the accessory of FIG. 14 configured to receive a removable cleaning head, consistent with embodiments of the present disclosure.

In some instances, the cleaning head 1401 may be detachable from the accessory 1400 (e.g., as shown in FIGS. 17 and 18). When the cleaning head 1401 is removed, the accessory 1400 may be used without bristles 1408. Additionally, or alternatively, in some instances, actuation of the toggle 308 may cause bristles 1408 extending from the cleaning head 1401 to transition between extended and retracted states.

Figure 19:
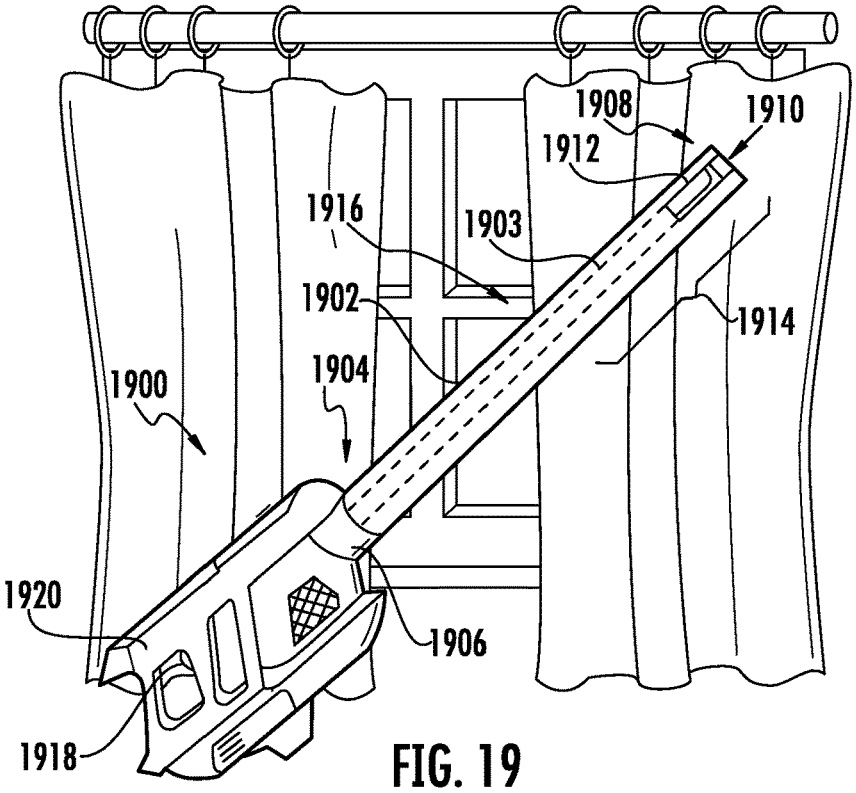
FIG. 19 is a schematic perspective view of a handheld surface treatment apparatus having an accessory having a bleed valve coupled thereto, consistent with embodiments of the present disclosure.

FIG. 19 shows a schematic perspective view of a handheld surface cleaning apparatus 1900, which may be an example of the surface treatment apparatus 100 of FIG. 1 having an accessory 1902 coupled thereto, which may be an example of the accessory 110 of FIG. 1. As shown, the accessory 1902 defines an extension channel 1903 having a proximal end 1904 removably coupled to a coupling 1906 of the surface cleaning apparatus 1900 and a distal end 1908 having an inlet 1910 for suctioning air therethrough. The accessory 1902 can include an actuatable bleed valve 1912 that selectively fluidly couples the extension channel 1903 to a surrounding environment. As such, when the bleed valve 1912 is transitioned towards an open state (i.e., a position wherein the bleed valve 1912 fluidly couples the extension channel 1903 to the surrounding environment), an amount of suction at the inlet 1910 may be reduced. The reduced suction may, for example, allow a user of the handheld surface cleaning apparatus 1900 to more easily clean one or more blinds.

The actuatable bleed valve 1912 can be disposed along the accessory 1902 at a location between the proximal and distal ends 1904 and 1908. For example, the actuatable bleed valve 1912 can be positioned in a distal end region 1914. The distal end region 1914 can extend from the distal end 1908 to a midpoint point 1916 of the accessory 1902.

The bleed valve 1912 can be transitioned between open and closed states in response to, for example, the actuation of a toggle 1918. As shown, the toggle 1918 is disposed proximate a handle 1920 of the surface cleaning apparatus 1900. As such, a user of the surface cleaning apparatus 1900 can actuate the toggle 1918 while continuing to use the surface cleaning apparatus 1900. The toggle 1918 can be, for example, a button configured to be depressed (e.g., in a direction away from the user) or a trigger configured to be pulled (e.g., in a direction toward the user).

Figure 20:
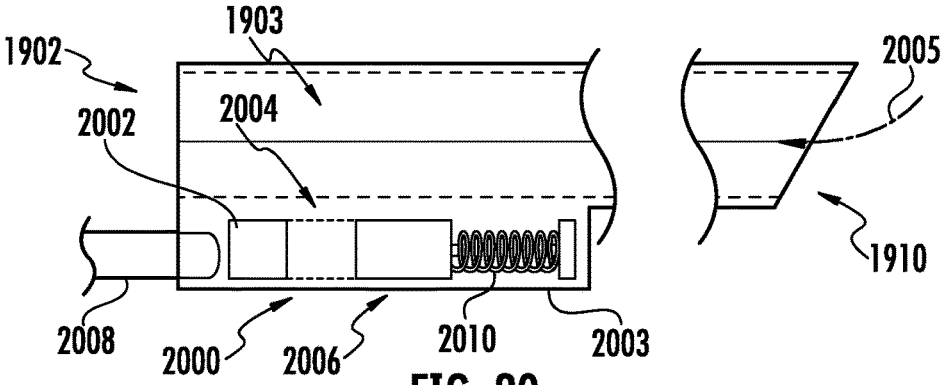
FIG. 20 is a schematic cross-sectional view of an example of the bleed valve of FIG. 19 in a closed state, consistent with embodiments of the present disclosure.
Figure 21:
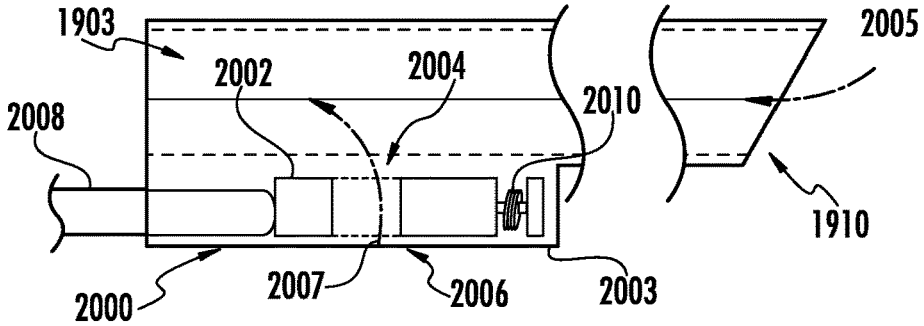
FIG. 21 is a schematic cross-sectional view of the bleed valve of FIG. 20 in an open state, consistent with embodiments of the present disclosure.

FIGS. 20 and 21 show a schematic cross-sectional view of a bleed valve 2000, which may be an example of the bleed valve 1912 of FIG. 19. As shown, the bleed valve 2000 includes a bleed valve body 2002 having a bleed valve opening 2004 extending therethrough. When the bleed valve 2000 is in the closed state (e.g., as shown in FIG. 20) the valve body 2002 extends over a channel opening 2006 defined in the accessory 1902 such that the bleed valve opening 2004 is not aligned with the channel opening 2006. As shown, when the bleed valve 2000 is in the closed state, air flows through the inlet 1910 according to a first flow path 2005. When the bleed valve 2000 is in the open state (e.g., as shown in FIG. 21), the bleed valve body 2002 is moved relative to an accessory body 2003 of the accessory 1902 such that the bleed valve opening 2004 aligns with the channel opening 2006, fluidly coupling the extension channel 1903 to the surrounding environment via the bleed valve 2000. As shown, when the bleed valve 2000 is in the open state air flows through the inlet 1910 according to the first flow path 2005 and through the bleed valve 2000 according to a second flow path 2007.

The bleed valve body 2002 is moved relative to the accessory body 2003 of the accessory 1902 in response to a movement of an actuator 2008. The actuator 2008 engages (e.g., contacts) the bleed valve body 2002. The actuator 2008 is configured to move in response to, for example, actuation of the toggle 1918 (FIG. 19). As shown, a biasing mechanism 2010 can be provided to urge the bleed valve body 2002 towards the closed state. As such, when the actuator 2008 returns to an unactuated state (e.g., comes out of engagement with the bleed valve body 2002), the bleed valve body 2002 is urged towards the closed state. The biasing mechanism 2010 may be, for example, a spring (e.g., a tension spring, a torsion spring, a compression spring, and/or any other suitable spring), an elastic material (e.g., a rubber), and/or any other suitable biasing mechanism.

Figure 22:
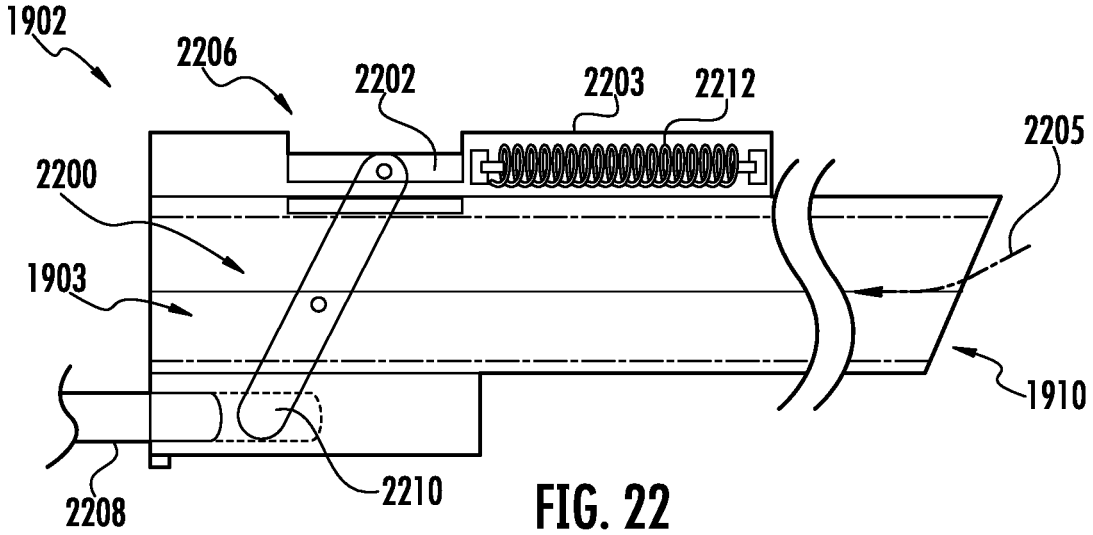
FIG. 22 is a schematic cross-sectional view of another example of the bleed valve of FIG. 19 in a closed state, consistent with embodiments of the present disclosure.
Figure 23:
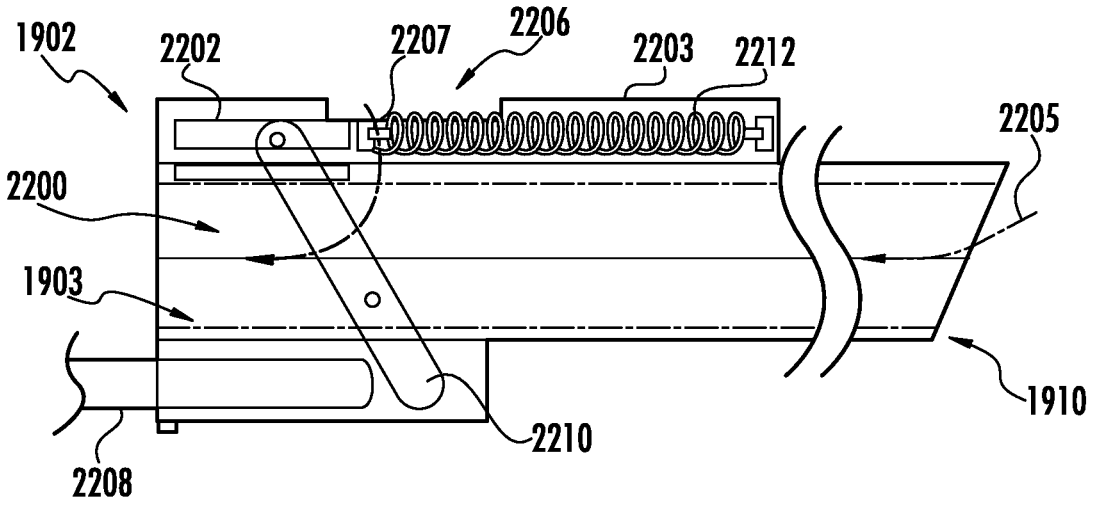
FIG. 23 is a schematic cross-sectional view of the bleed valve of FIG. 22 in an open state, consistent with embodiments of the present disclosure.

FIGS. 22 and 23 show a schematic cross-sectional view of a bleed valve 2200, which may be an example of the bleed valve 1912 of FIG. 19. As shown, the bleed valve 2200 includes a bleed valve body 2202. When the bleed valve 2200 is in the closed state (e.g., as shown in FIG. 22), the bleed valve body 2202 extends over a channel opening 2206 defined in the accessory 1902. As shown, when the bleed valve 2200 is in the closed state, air flows through the inlet 1910 according to a first flow path 2205. When the bleed valve 2200 is in the open state (e.g., as shown in FIG. 23), the bleed valve body 2202 is moved relative to an accessory body 2203 of the accessory 1902 such that the bleed valve body 2202 no longer extends over the channel opening 2206. As such, the extension channel 1903 is fluidly coupled to the surrounding environment via the bleed valve 2200. As shown, when the bleed valve 2200 is in the open state air flows through the inlet 1910 according to the first flow path 2205 and through the bleed valve according to a second flow path 2207.

The bleed valve body 2202 is moved relative to the accessory body 2203 of the accessory 1902 in response to a movement of an actuator 2208. The actuator 2008 engages (e.g., contacts) a pivot arm 2210 pivotally coupled to the accessory body 2203. The pivot arm 2210 engages (e.g., contacts) the bleed valve body 2202 such that the bleed valve body 2202 is urged towards the open state in response to the pivotal movement of the pivot arm 2210. The bleed valve body 2202 can be biased towards the closed state using a biasing mechanism 2212. As such, when the actuator 2208 returns to an unactuated state (e.g., comes out of engagement with the pivot arm 2210), the bleed valve body 2202 is urged towards the closed state. The biasing mechanism 2212 may be, for example, a spring (e.g., a tension spring, a torsion spring, a compression spring, and/or any other suitable spring), an elastic material (e.g., a rubber), and/or any other suitable biasing mechanism.

Figure 24:
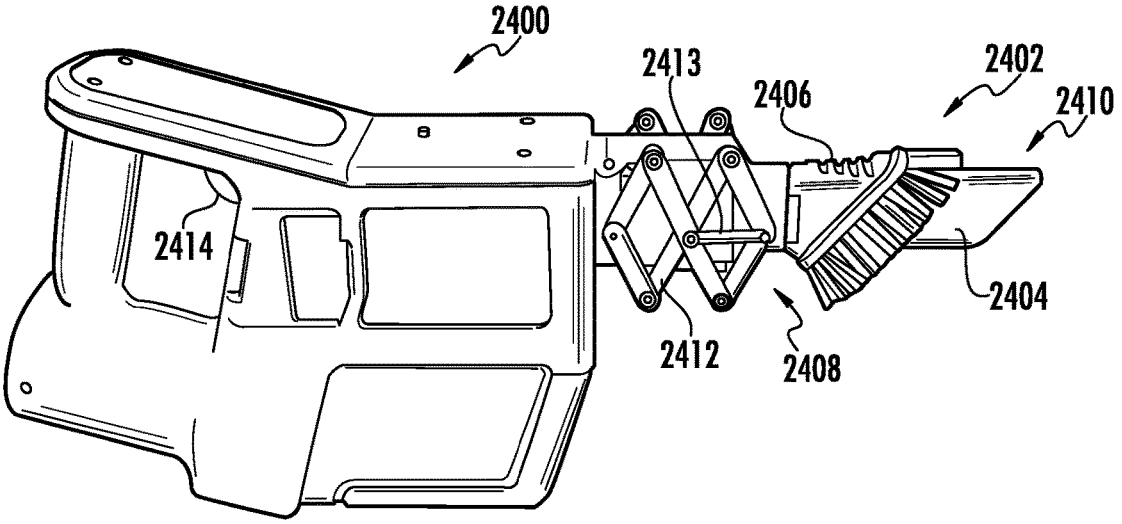
FIG. 24 is a perspective view of a handheld surface treatment apparatus having an accessory that includes a scissor mechanism coupled thereto, the scissor mechanism being in a retracted state, consistent with embodiments of the present disclosure.
Figure 25:
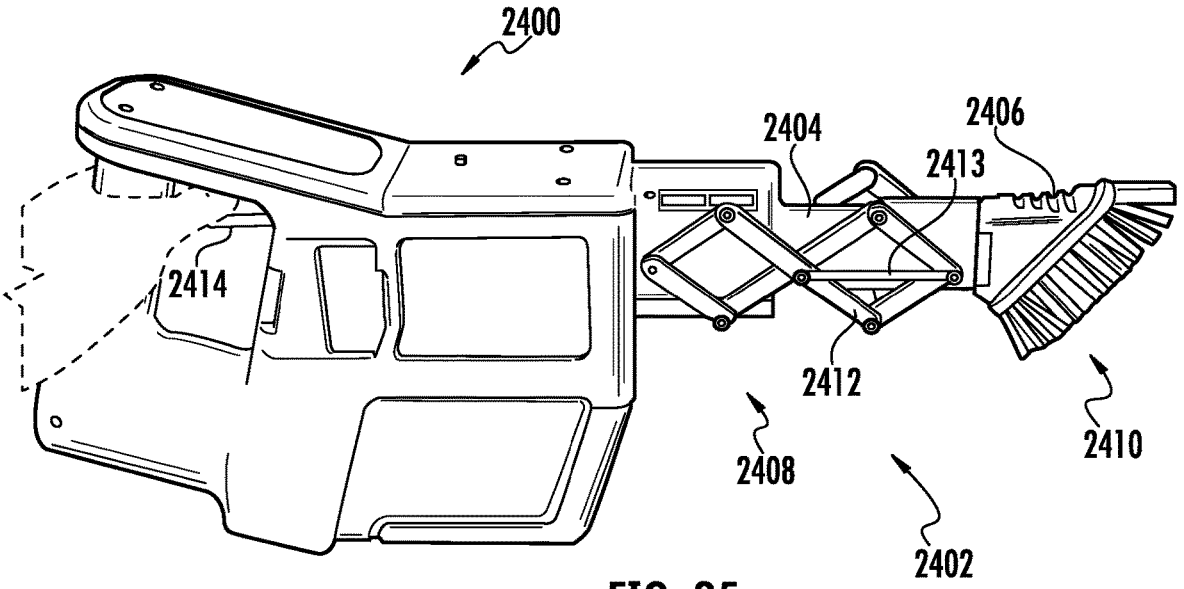
FIG. 25 is a perspective view of the handheld surface treatment apparatus of FIG. 24, wherein the scissor mechanism is in an extended state, consistent with embodiments of the present disclosure.

FIGS. 24 and 25 show a handheld surface cleaning apparatus 2400, which may be an example of the surface treatment apparatus 100 of FIG. 1 having an accessory 2402 coupled thereto, which may be an example of the accessory 110 of FIG. 1. The accessory 2402 can include a crevice tool 2404 and a brush tool 2406 slideably coupled to the crevice tool 2404. The brush tool 2406 can slide between a proximal end region 2408 of the crevice tool 2404 and a distal end region 2410 of the crevice tool 2404. When at the distal end region 2410 of the crevice tool 2404, the brush tool 2406 can be used to clean a surface (e.g., a floor).

The accessory 2402 can also include a scissor mechanism 2412. A first portion of the scissor mechanism 2412 can be coupled to the proximal end region 2408 of the crevice tool 2404 and a second portion of the scissor mechanism 2412 can be coupled to the brush tool 2406. As such, when the scissor mechanism 2412 transitions between a retracted state (e.g., as shown in FIG. 24) and an extended state (e.g., as shown in FIG. 25), the brush tool 2406 slides along the crevice tool 2406 between a stored state (e.g., as shown in FIG. 24) and a use state (e.g., as shown in FIG. 25). Therefore, the accessory 2402 can generally be described as changing operational states (e.g., between a crevice accessory and a brush accessory) in response to the brush tool 2406 transitioning between stored and use states.

The scissor mechanism 2412 can be caused to transition between the retracted state and the extended state in response to actuation of a toggle 2414. A biasing mechanism 2413 can be provided to urge the scissor mechanism 2412 towards the retracted state. For example, when the toggle 2414 is a non-latching toggle, the biasing mechanism 2413 may cause the scissor mechanism 2412 to transition from the extended state to the retracted state in response to a user releasing the toggle 2414. The biasing mechanism 2413 may be, for example, a spring (e.g., a tension spring, a torsion spring, a compression spring, and/or any other suitable spring), an elastic material (e.g., a rubber), and/or any other suitable biasing mechanism.

Figure 26:
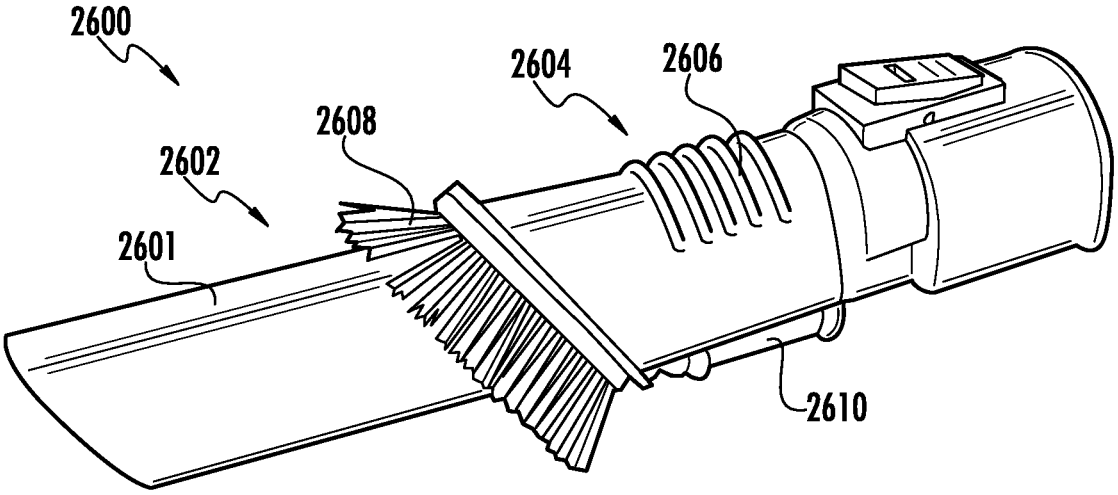
FIG. 26 is a perspective view of an accessory having a crevice tool and a brush tool for a surface treatment apparatus, wherein the brush tool is in a stored state, consistent with embodiments of the present disclosure.
Figure 27:
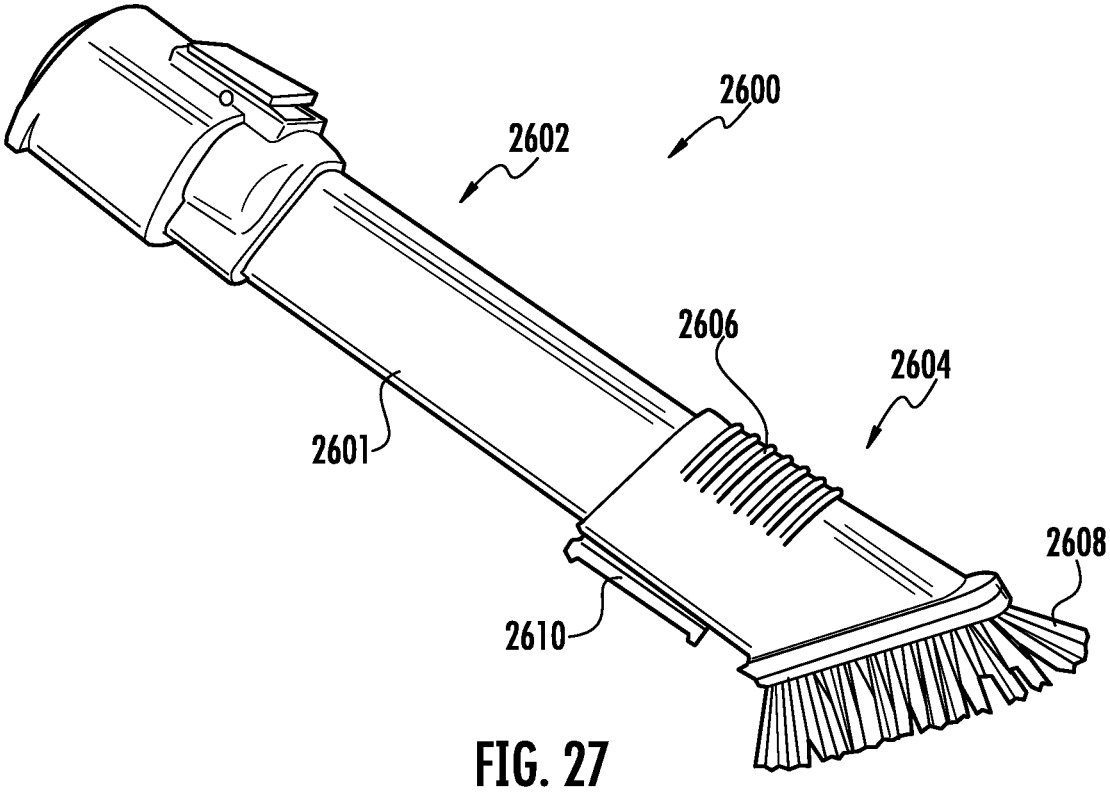
FIG. 27 is a perspective view of the accessory of FIG. 26 having the brush tool in the use state, consistent with embodiments of the present disclosure.

FIGS. 26 and 27 show perspective views of an accessory 2600, which may be an example of the accessory 110 of FIG. 1. As shown, the accessory 2600 includes a crevice tool 2602 and a brush tool 2604. The brush tool 2604 includes a brush body 2606 and one or more bristles 2608 extending from the brush body 2606. The brush body 2606 extends around a crevice tool body 2601. The brush tool 2604 is configured to slideably engage the crevice tool body 2601 such that the brush tool 2604 can transition between a stored state (e.g., as shown in FIG. 26) and a use state (e.g., as shown in FIG. 27). Therefore, the accessory 2600 can generally be described as changing operational states (e.g., between a crevice accessory and a brush accessory) in response to the brush tool 2604 transitioning between stored and use states. The brush tool 2604 can transition between the stored state and the use state in response to a user changing an orientation of the accessory 2600 such that gravity urges the brush tool 2604 to the desired state.

The brush body 2606 can include a latch 2610 configured to engage the crevice tool 2602 such that the brush tool 2604 can selectively transition between the stored state and the use state. The latch 2610 can be configured to engage the crevice tool 2602 such that the brush tool 2604 is retained at a desired state.

Figure 28:
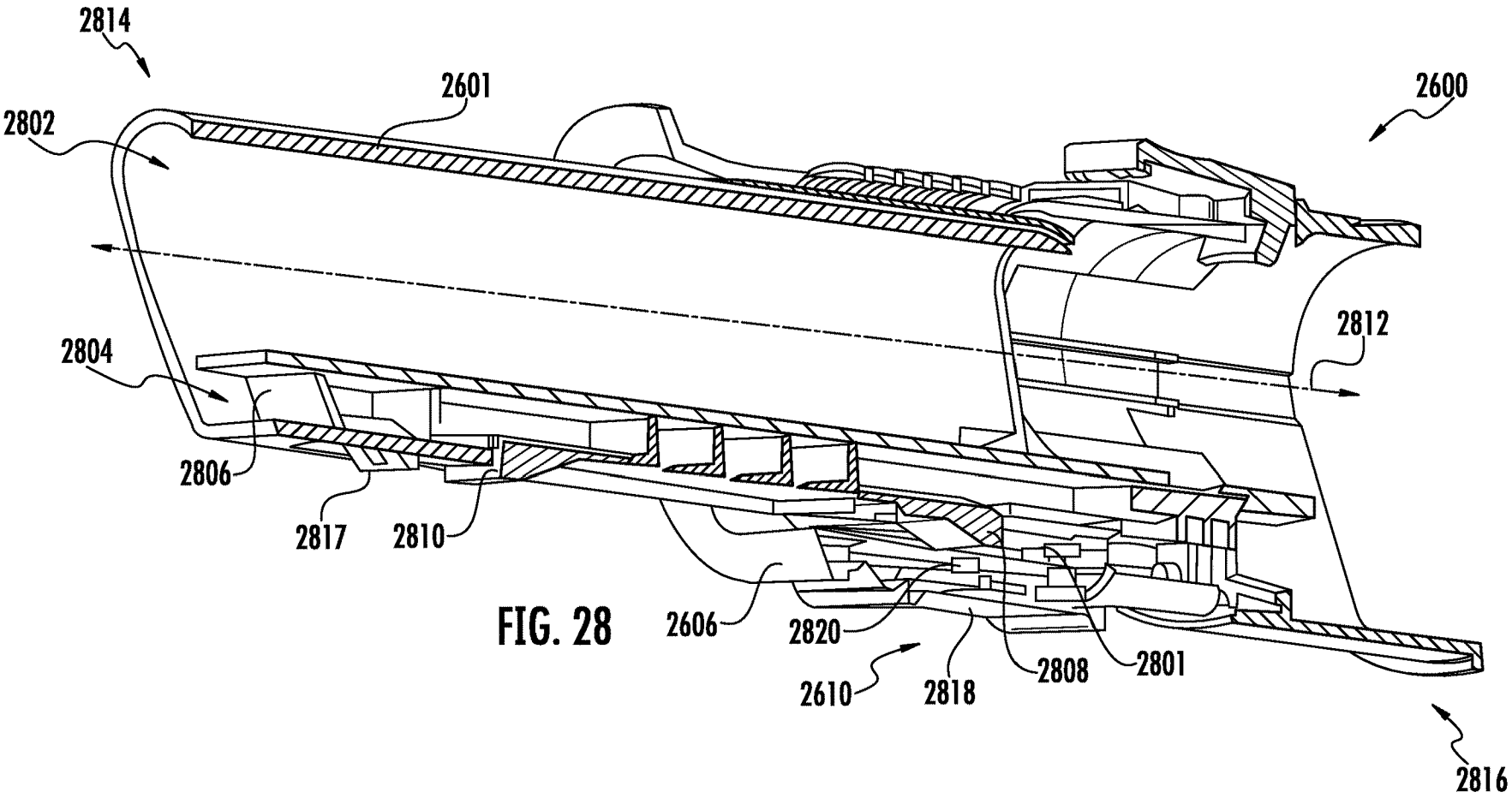
FIG. 28 is a cross-sectional view of the accessory of FIG. 26 having the bristles removed from the brush tool, consistent with embodiments of the present disclosure.

FIG. 28 is a cross-sectional view of the accessory 2600 without the bristles 2608 extending from the brush body 2606. As shown, the crevice tool body 2601 defines an air channel 2802 through which air urged and an actuator channel 2804 for receiving a moveable bar 2806. The moveable bar 2806 includes a storage catch 2808 and a use catch 2810. The storage and use catches 2808 and 2810 are configured to engage a retaining bar 2801 of the latch 2610 such that the brush body 2606 is retained in a respective one of the stored state or the use state.

The moveable bar 2806 is configured to move in a direction parallel to a crevice tool longitudinal axis 2812. As the moveable bar 2806 is urged towards a distal end 2814 of the crevice tool body 2601, the storage and use catches 2808 and 2810 are urged into the actuator channel 2804 such that the retaining bar 2801 does not engage the storage catch 2808 or the use catch 2810. As such, the brush body 2606 is able to slide relative to the crevice tool body 2601. As the moveable bar 2806 is urged towards a proximal end 2816 of the crevice tool body 2601, the storage and use catches 2808 and 2810 are urged out of the actuator channel 2804 such that the retaining bar 2801 engages a respective one of the storage catch 2808 or the use catch 2810. Therefore, moving the moveable bar 2806 in a direction of the distal end 2814 of the crevice tool body 2601 allows the brush body 2606 to transition between the stored and use states and moving the moveable bar 2806 in a direction of the proximal end 2816 of the crevice tool body 2601 allows the brush body 2606 to be retained in a respective one of the store or use states. In some instances, the moveable bar 2806 can be biased towards the proximal end 2816 using, for example, a biasing mechanism. The biasing mechanism may be, for example, a spring (e.g., a tension spring, a torsion spring, a compression spring, and/or any other suitable spring), an elastic material (e.g., a rubber), and/or any other suitable biasing mechanism.

The moveable bar 2806 can include a retaining catch 2817 configured prevent the brush body 2606 from disengaging the crevice tool body 2601. As shown, the use catch 2810 is disposed between the storage catch 2808 and the retaining catch 2817. As such, when the brush body 2606 is in the use state the retaining bar 2801 is disposed between the retaining catch 2817 and the use catch 2810.

The latch 2610 can include a lever 2818 configured to transition between an unactuated state and an actuated state. When the lever 2818 is transitioned to the actuated state, the lever 2818 urges a respective one or more of the storage catch 2808, the use catch 2810, and/or the retaining catch 2817 into the actuator channel 2804 such that the brush body 2606 can move relative to the crevice tool body 2601. As such, the brush body 2606 is capable of transitioning between stored and use states without moving the moveable bar 2806 in a direction parallel to the crevice tool longitudinal axis 2812. When in the use state, transitioning the lever 2818 to an actuated state may urge the retaining catch 2817 into the actuator channel 2804 such that the brush body 2606 can be removed from the crevice tool body 2601.

The lever 2818 can include one or more protrusions 2820 configured to engage a respective one or more of the storage catch 2808, the use catch 2810, and/or the retaining catch 2817. The one or more protrusions 2820 can urge respective ones of the storage catch 2808, the use catch 2810, and/or the retaining catch 2817 into the actuator channel 2804.

Figure 29:
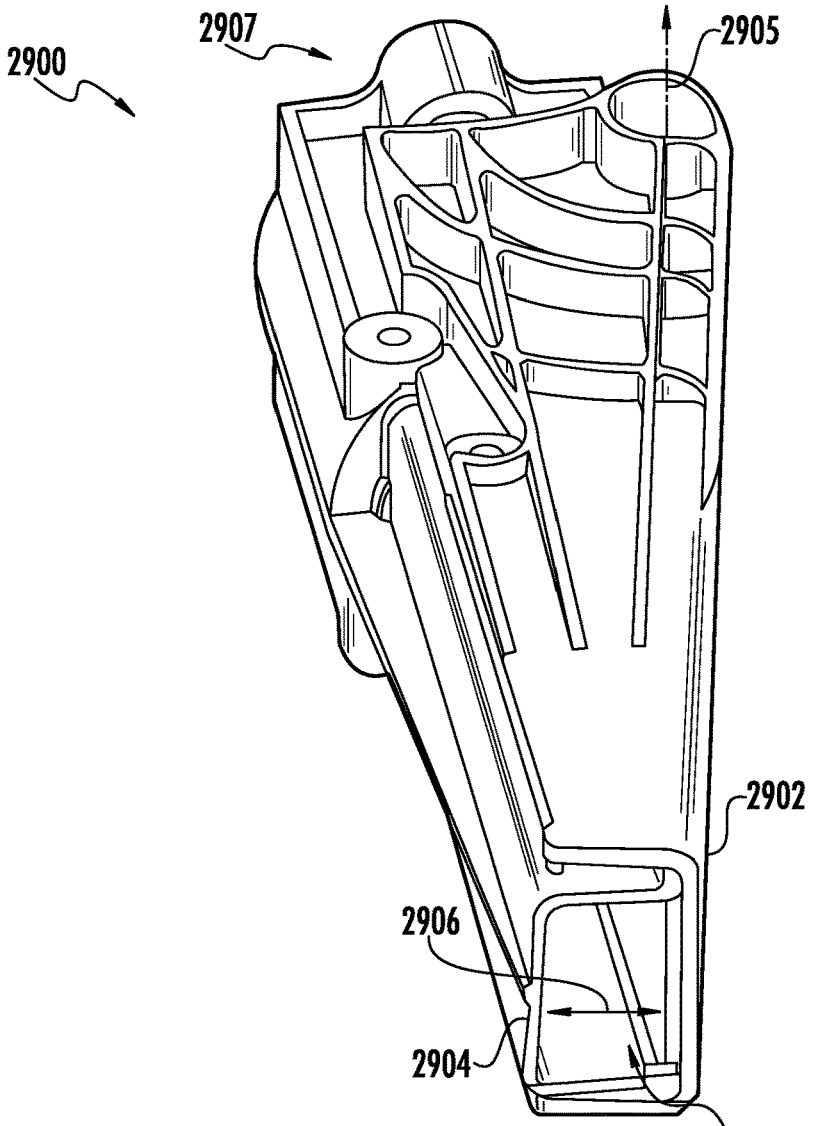
FIG. 29 shows a perspective view of an accessory for a surface treatment apparatus, the accessory having an expanding inlet, the accessory being in an unexpanded state, consistent with embodiments of the present disclosure.
Figure 30:
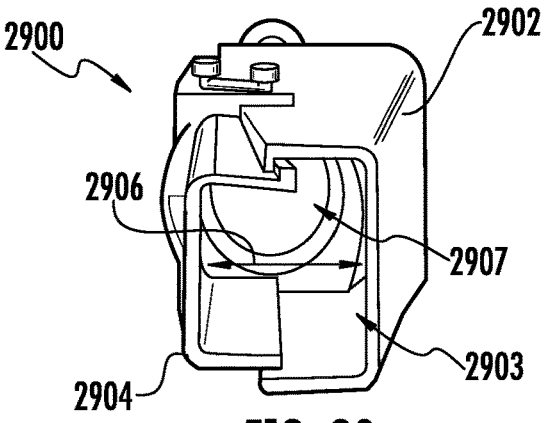
FIG. 30 shows a perspective view of the accessory of FIG. 29 in an expanded state, consistent with embodiments of the present disclosure.

FIG. 29 shows a perspective view of an accessory 2900, which may be an example of the accessory 110 of FIG. 1. The accessory 2900 includes a first body portion 2902 and a second body portion 2904 such that an air channel 2903 is defined between the first and second body portions 2902 and 2904. The first body portion 2902 is pivotally coupled to the second body portion 2904 such that the first body portion 2902 pivots about a pivot axis 2905. As shown, the pivot axis 2905 can be located proximate to an air outlet 2907 of the accessory 2900. The pivotal motion of the first body portion 2902 relative to the second body portion 2904 results in a measure of an inlet width 2906 of the air channel 2903 increasing or decreasing. As such, a measure of the inlet width 2906 may be varied between a maximum width (e.g., as shown in FIG. 30) and a minimum width (e.g., as shown in FIG. 29) by a user of the accessory 2900. Therefore, the accessory 2900 may generally be described as being configured to transition between an unexpanded state (e.g., as shown in FIG. 29) and an expanded state (e.g., as shown in FIG. 30). In some instances, the first body portion 2902 may be biased towards the second body portion 2904 using, for example, a biasing mechanism. The biasing mechanism may be, for example, a spring (e.g., a tension spring, a torsion spring, a compression spring, and/or any other suitable spring), an elastic material (e.g., a rubber), and/or any other suitable biasing mechanism.

Figure 32:
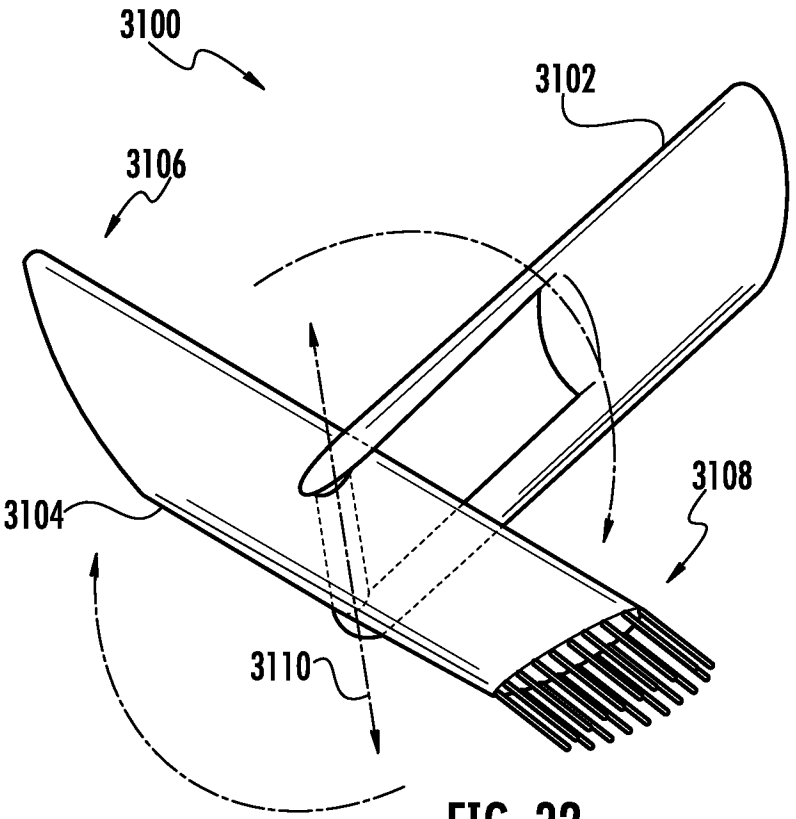
FIG. 32 shows a schematic perspective view of the accessory of FIG. 31, wherein the rotating tool body is illustrated as being rotated, consistent with embodiments of the present disclosure.
Figure 31:
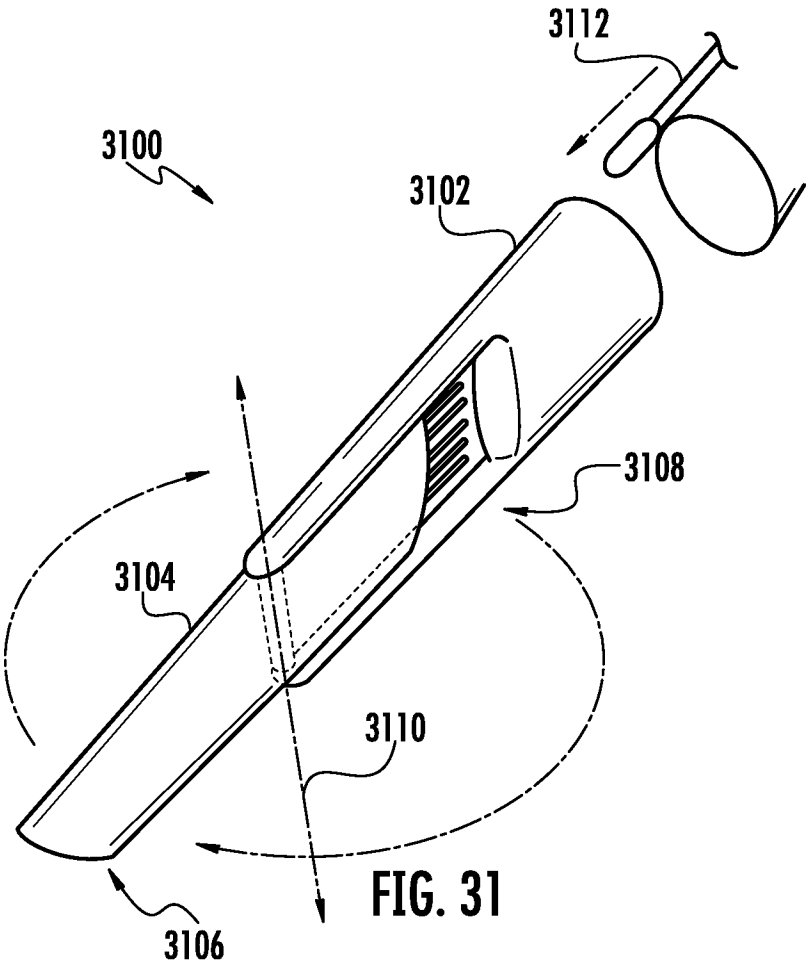
FIG. 31 shows a schematic perspective view of an accessory for a surface treatment apparatus, the accessory includes a rotating tool body, consistent with embodiments of the present disclosure.

FIGS. 31 and 32 show schematic perspective views of an accessory 3100, which may be an example of the accessory 110 of FIG. 1. As shown, the accessory 3100 includes a main body 3102 and a tool body 3104. The tool body 3104 includes a first tool end 3106 having a first cleaning tool (e.g., a crevice tool) and a second tool end 3108 having a second cleaning tool (e.g., a brush tool). The tool body 3104 is rotatably coupled to the main body 3102 such that the tool body 3104 can be rotated about a rotation axis 3110. Rotation of the tool body 3104 allows the first cleaning tool to be transitioned from a use state to a stored state and the second cleaning tool to be transitioned from the stored state to the use state. For example, the tool body 3104 can be configured to rotate 180° when transitioning the first and second cleaning tools between the use and stored states.

An actuator 3112 can be configured to transition between an actuated and unactuated state. The actuator 3112 can be included with, for example, a surface treatment apparatus, such as the surface treatment apparatus 100 of FIG. 1. When in the actuated state, the tool body 3104 can be rotated relative to the main body 3102 (e.g., such that the first cleaning tool can be transitioned to a use state). When in the unactuated state, the tool body 3104 may be prevented from rotating (e.g., such that the first cleaning tool can be maintained in its current state).

Figure 33:
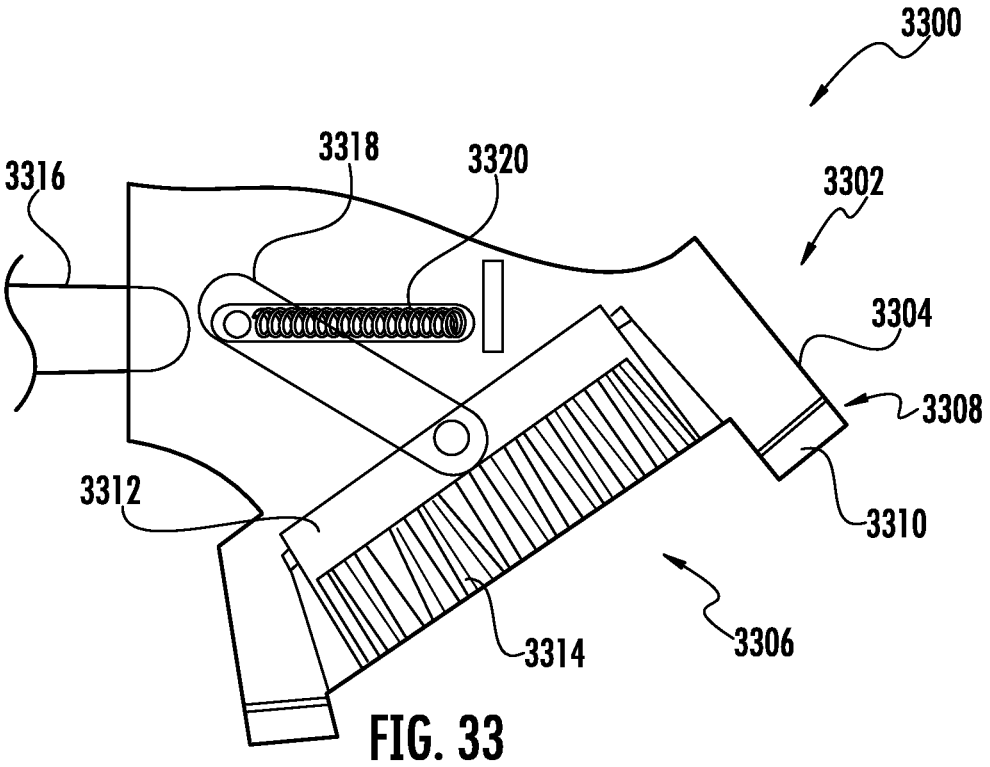
FIG. 33 shows a schematic cross-sectional view of an accessory for a surface treatment apparatus, the accessory including a first and second cleaning feature, wherein the second cleaning feature is in a stored state, consistent with embodiments of the present disclosure.
Figure 34:
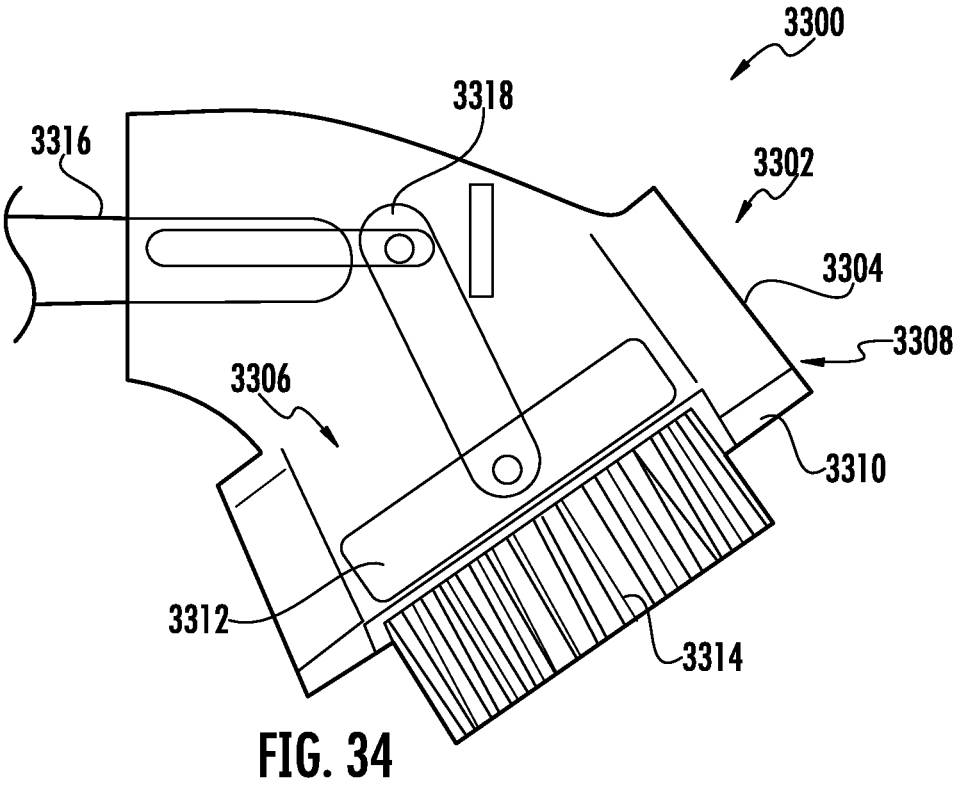
FIG. 34 shows a schematic cross-sectional view of the cleaning accessory of FIG. 33, wherein the second cleaning feature is in a use state, consistent with embodiments of the present disclosure.

FIGS. 33 and 34 show schematic cross-sectional views of an accessory 3300, which may be an example of the accessory 110 of FIG. 1. The accessory 3300 includes a main body 3302 having one or more sidewalls 3304 that define a main body cavity 3306. A cleaning surface facing end 3308 of the sidewalls 3304 can include a first cleaning feature 3310. The first cleaning feature 3310 may include, for example, a soft brush.

The main body cavity 3306 is configured to be fluidly coupled to a surface treatment apparatus such as, for example, the surface treatment apparatus 100 of FIG. 1. For example, the main body cavity 3306 can include at least two open ends. As shown, the main body cavity 3306 can also be configured to include a moveable cleaning body 3312. The moveable cleaning body 3312 can define a cleaning body cavity that can be fluidly coupled to a surface treatment apparatus such as, for example, the surface treatment apparatus 100 of FIG. 1. For example, the cleaning body cavity can include at least two open ends.

The moveable cleaning body 3312 can include a second cleaning feature 3314. The second cleaning feature 3314 may include, for example, a firm brush (e.g., as compared the first cleaning feature 3310). The moveable cleaning body 3312 is configured to move within the main body cavity 3306 such that the second cleaning feature 3314 can transition between a stored state (e.g., as shown in FIG. 33) and a use state (e.g., as shown in FIG. 34). When in the stored state, the second cleaning feature 3314 can be disposed within the main body cavity 3306 such that the second cleaning feature 3314 is recessed relative to the first cleaning feature 3310. Therefore, the accessory 3300 can generally be described as changing operational states (e.g., between a first and second cleaning feature) in response to the moveable cleaning body 3312 moving within the main body cavity 3306.

The second cleaning feature 3314 can be transitioned between the stored and use states in response to actuation of an actuator 3316. The actuator 3316 can be included with a surface cleaning apparatus such as, for example, the surface cleaning apparatus 100 of FIG. 1. When the actuator 3316 is actuated, the actuator 3316 urges an arm 3318 towards an actuated state (e.g., as shown in FIG. 34). As the arm 3318 moves towards the actuated state, the arm 3318 urges the moveable cleaning body 3312 to move relative to the main body cavity 3306 such that the second cleaning feature 3314 is urged towards the use state. As shown, the arm 3318 can be biased towards an unactuated state (e.g., as shown in FIG. 33) using, for example, a biasing mechanism 3320 (e.g., spring). As such, when the actuator 3316 is in an unactuated state, the arm 3318 urges the cleaning body to move relative to the main body cavity 3306 such that the second cleaning feature 3314 is urged toward the stored state.

Figure 35:
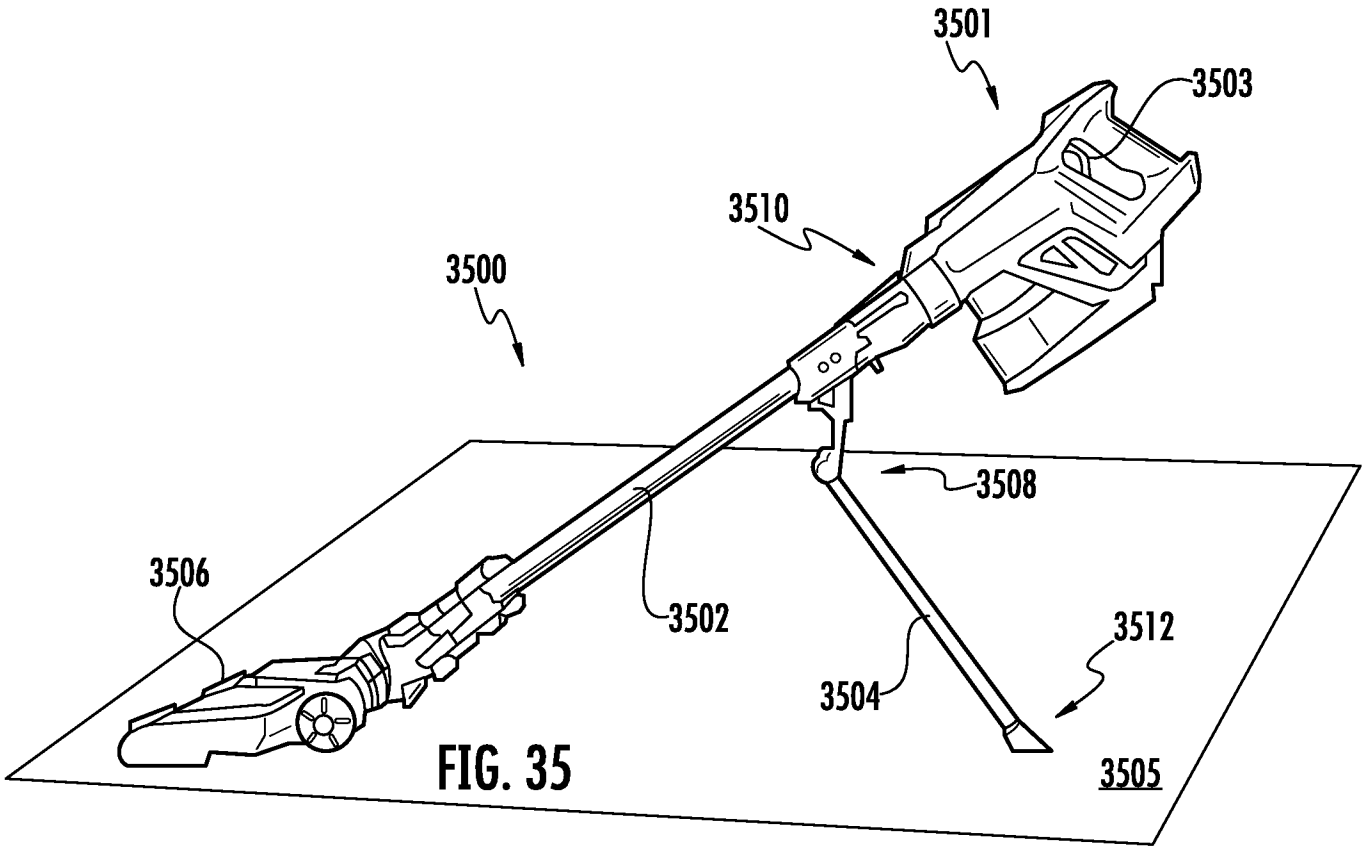
FIG. 35 shows a side view of a handheld surface treatment apparatus coupled to an accessory having a stand in a use state, consistent with embodiments of the present disclosure.

FIG. 35 shows a side view of an example of the handheld surface cleaning apparatus 3501, which may be an example of the surface cleaning apparatus 100 of FIG. 1, fluidly coupled to an accessory 3500, which may be an example of the accessory 110 of FIG. 1. The accessory 3500 can include a wand 3502 having a stand 3504. The wand 3502 is fluidly coupled to the handheld surface cleaning apparatus 3501. The wand 3502 can also be fluidly coupled to a surface cleaning head 3506. The stand 3504 is configured such that the stand 3504 transitions between a use state and a stored state.

The stand 3504 may transition between the use state and the stored state in response to the actuation of a toggle 3503 (e.g., a trigger or button). When in the stored state, the stand 3504 is positioned adjacent the wand 3502 such that an operator of the handheld surface cleaning apparatus 3501 can move the surface cleaning head 3506 over a surface 3505 (e.g., a floor). When the stand 3504 is in the use state, the stand 3504 extends in a direction away from the wand 3502 such that the stand 3504 engages the surface 3505. The engagement of the stand 3504 with the surface 3505 supports the handheld surface cleaning apparatus 3501 at a location above the surface 3505.

A first end 3508 of the stand 3504 is pivotally coupled to the wand 3502. The first end 3508 of the stand 3504 is coupled to the wand 3502 at a location proximate to an air inlet 3510 of the handheld surface cleaning apparatus 3501. When in the stored state, a second end 3512 of the stand 3504 may be releasably coupled to the wand 3502 at a location proximate the surface cleaning head 3506. In response to the toggle 3503 being actuated, the second end 3512 of the stand 3504 can pivot in a direction of the surface 3505.

Once in the use state, the stand 3504 may be further pivoted such that the stand 3504 transitions in to a locked state. When in the locked state and the toggle 3503 is actuated an additional time, the stand 3504 may be urged in a direction of the wand 3502 (e.g., towards the stored state). The stand 3504 may be urged to the stored state using, for example, a biasing mechanism. Therefore, the biasing mechanism may generally be described as urging the stand 3504 from the use state to the stored state in response to the actuation of the toggle 3503. The biasing mechanism may be, for example, a spring (e.g., a tension spring, a torsion spring, a compression spring, and/or any other suitable spring), an elastic material (e.g., a rubber), and/or any other suitable biasing mechanism.

Figure 37:
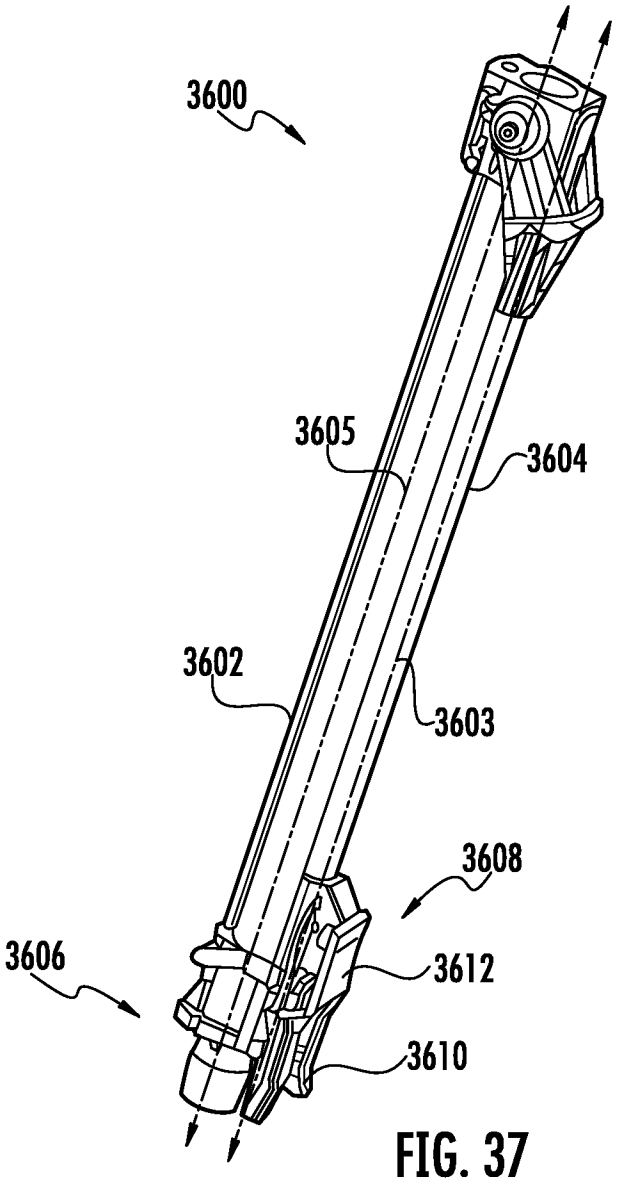
FIG. 37 shows a perspective view of the accessory of FIG. 36, wherein the stand is in a stored state, consistent with embodiments of the present disclosure.
Figure 36:
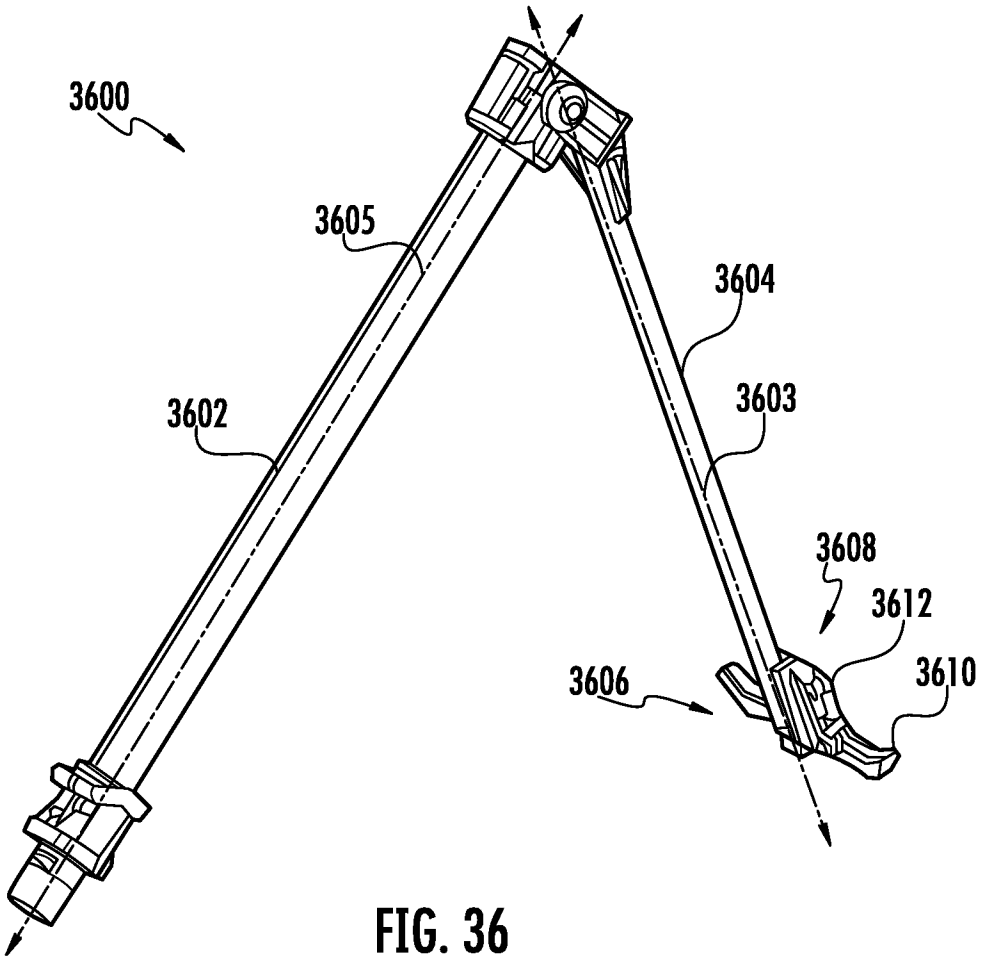
FIG. 36 shows a perspective view of an example of the accessory of FIG. 35, wherein the stand is in the use state, consistent with embodiments of the present disclosure.

FIGS. 36 and 37 show perspective views of an accessory 3600, which may be an example of the accessory 3500 of FIG. 35. As shown, the accessory 3600 includes a wand 3602 and a stand 3604 pivotally coupled to the wand 3602. The stand 3604 is configured to pivot between a use state (e.g., as shown in FIG. 36) and a stored state (e.g., as shown in FIG. 37). When in the use state, a stand longitudinal axis 3603 of the stand 3604 extends transverse to a wand longitudinal axis 3605 of the wand 3602 such that the stand 3604 can engage a surface (e.g., a floor). When in the stored state, the stand longitudinal axis 3603 can extend substantially parallel to the wand longitudinal axis 3605 such that the stand 3604 does not engage the surface.

As shown, an expanding foot 3608 can be provided proximate a distal end 3606 of the stand 3604, the distal end 3606 of the stand 3604 being proximate a surface (e.g., a floor). The expanding foot 3608 can be configured to engage a surface (e.g., a floor) when the stand 3604 is in the use state. The expanding foot 3608 includes supports 3610 pivotally coupled to a foot body 3612. The supports are configured to transition between a stored state (e.g., as shown in FIG. 36) to a use state (e.g., as shown in FIG. 37) in response to the stand 3604 transitioning from the stored state to the use state. For example, when the supports 3610 engage (e.g., contact) a surface (e.g., a floor), the supports 3610 are urged to the use state in response to the engagement with the surface. A biasing mechanism can be provided to bias the supports 3610 towards the stored state such that as the stand transitions to the stored state, the supports 3610 transition to the stored state. The biasing mechanism may be, for example, a spring (e.g., a tension spring, a torsion spring, a compression spring, and/or any other suitable spring), an elastic material (e.g., a rubber), and/or any other suitable biasing mechanism. In some instances, the supports 3610 can include one or more wheels such that the supports 3610 can better pivot when engaging the surface.

Figure 38:
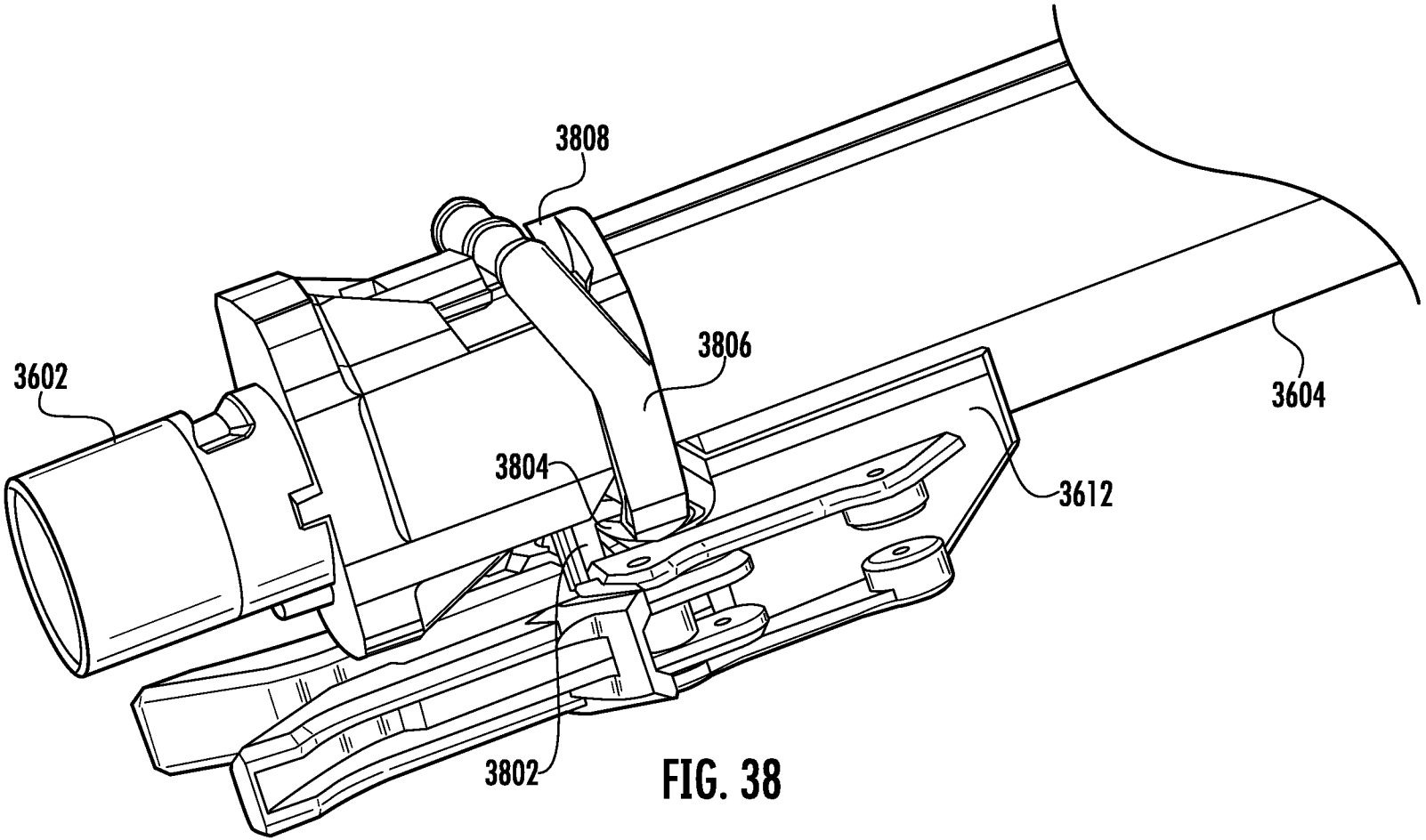
FIG. 38 is a magnified perspective view of a portion of the accessory of FIG. 37, consistent with embodiments of the present disclosure.

FIG. 38 shows a magnified perspective view of a portion of the stand 3604 and the wand 3602, wherein the stand 3604 is in the stored state. As shown, when the stand 3604 is in the stored state, a latch 3802 extending from, for example, the stand 3604 or the foot body 3612 engages a corresponding catch 3804 coupled to the wand 3602. As shown, the catch 3804 extends from a catch body 3806. The catch body 3806 can be pivotally coupled to the wand 3602 such that the catch body 3806 can pivot between a retaining state and a release state. For example, the catch body 3806 can be pivot from the retaining state to the release state in response to actuation of a catch actuator 3808. As the catch body 3806 pivots, the catch 3804 comes out of engagement with the latch 3802. When the catch 3804 comes out of engagement with the latch 3802, the stand 3604 can transition to the use state. When the catch actuator 3808 is not actuated, the catch body can be biased towards the retaining state (e.g., using a spring).

Figure 39:
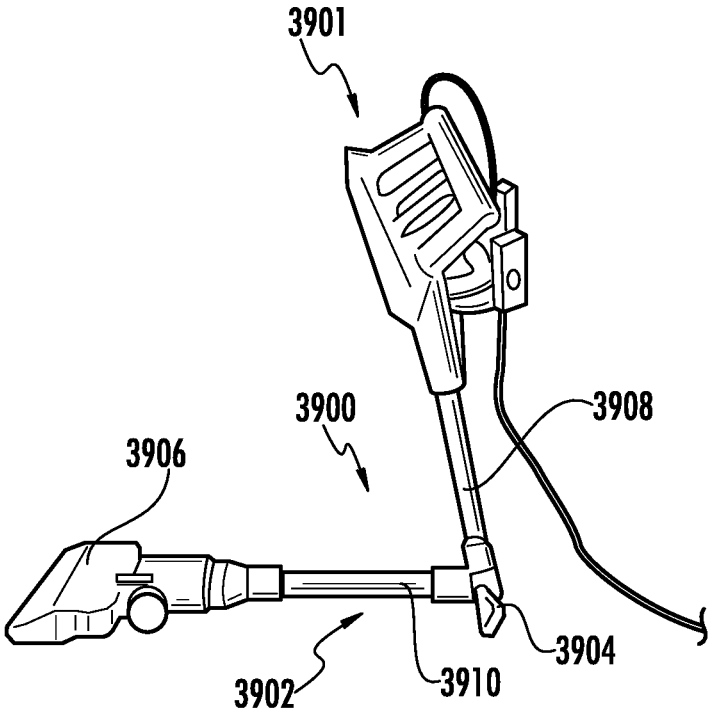
FIG. 39 shows a perspective view of a handheld surface treatment apparatus having an accessory coupled thereto, wherein the accessory includes a pivot joint, consistent with embodiments of the present disclosure.

FIG. 39 shows a perspective view of a handheld surface cleaning apparatus 3901, which may be an example of the handheld surface cleaning apparatus 300 of FIG. 3, coupled to an accessory 3900, which may be an example of the accessory 110 of FIG. 1. The accessory 3900 includes a wand 3902 having a pivot joint 3904. The wand 3902 is fluidly coupled to a surface cleaning head 3906. The pivot joint 3904 is disposed between the handheld surface cleaning apparatus 3901 and the surface cleaning head 3906. For example, the pivot joint 3904 may be disposed at or proximate to a midpoint of the wand 3902.

The pivot joint 3904 may pivot between a use state and a stored state when a toggle is actuated. For example, while the toggle is transitioned from a first state to a second state, the pivot joint 3904 may be capable of pivoting between the use and stored states. When in the use state, a first portion 3908 of the wand 3902 may be pivoted relative to a second portion 3910 of the wand 3902.

In some instances, the pivot joint 3904 may include a biasing mechanism that urges the pivot joint 3904 to the use and/or stored state. The biasing mechanism may be, for example, a spring (e.g., a tension spring, a torsion spring, a compression spring, and/or any other suitable spring), an elastic material (e.g., a rubber), and/or any other suitable biasing mechanism.

Figure 40:
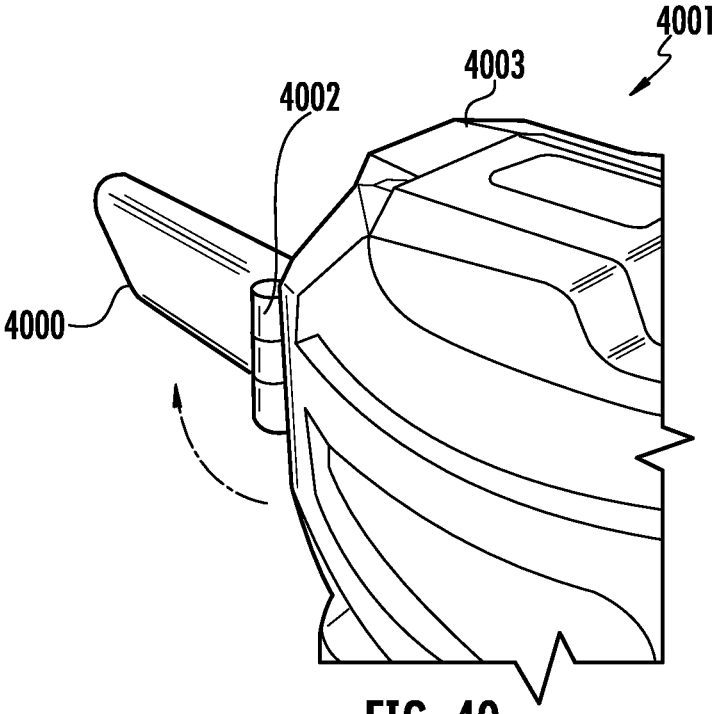
FIG. 40 shows a perspective schematic view of a portion of a handheld surface treatment apparatus having an onboard accessory that is transitionable between a use state and a stored state, consistent with embodiments of the present disclosure.

FIG. 40 shows a schematic perspective view of a handheld surface cleaning apparatus 4001, which may be an example of the surface cleaning apparatus 100 of FIG. 1, having an onboard accessory 4000. The onboard accessory 4000 may generally be described as an accessory non-removably coupled to the handheld surface cleaning apparatus 4001. For example, the onboard accessory 4000 can be pivotally coupled to a main body 4003 of the handheld surface cleaning apparatus 4001. As shown, the onboard accessory 4000 is pivotally coupled to the main body 4003 using hinge 4002. The onboard accessory 4000 transitions between a use state and a stored state in response to a toggle being actuated when an additional accessory is not coupled to the main body 4003. When the onboard accessory 4000 is in the use state, the onboard accessory 4000 is fluidly coupled to a debris canister of the surface cleaning apparatus 4001. When the onboard accessory 4000 is in the stored state, the onboard accessory 4000 is not fluidly coupled to the debris canister. As such, an additional accessory can be coupled to the handheld surface cleaning apparatus 4001.

Figure 41:
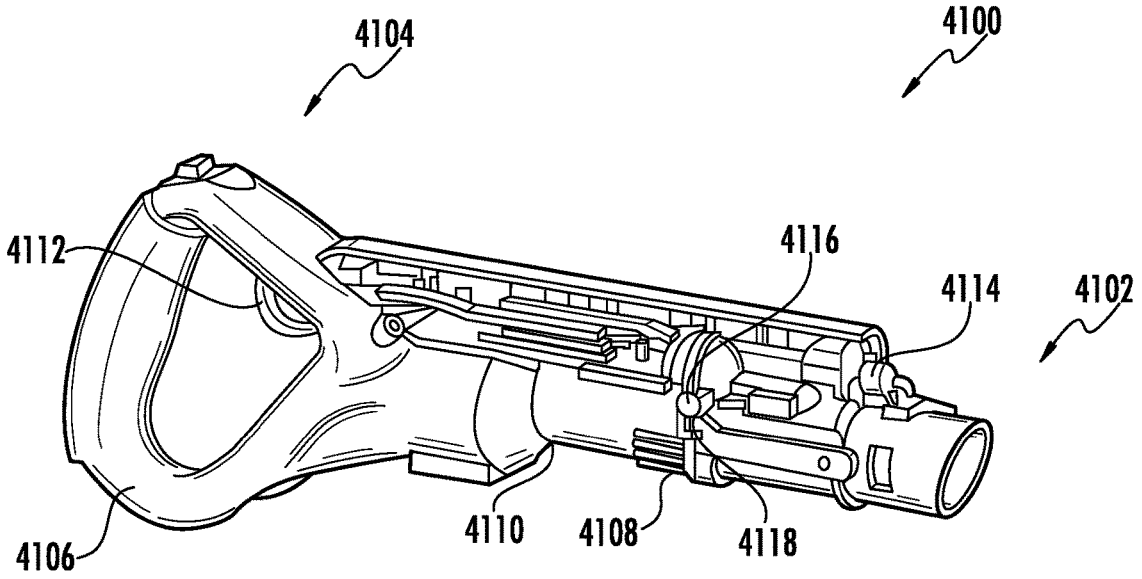
FIG. 41 is a perspective view of a handle assembly configured to be used with a surface treatment apparatus, the handle assembly including an onboard accessory in a stored state, consistent with embodiments of the present disclosure.
Figure 42:
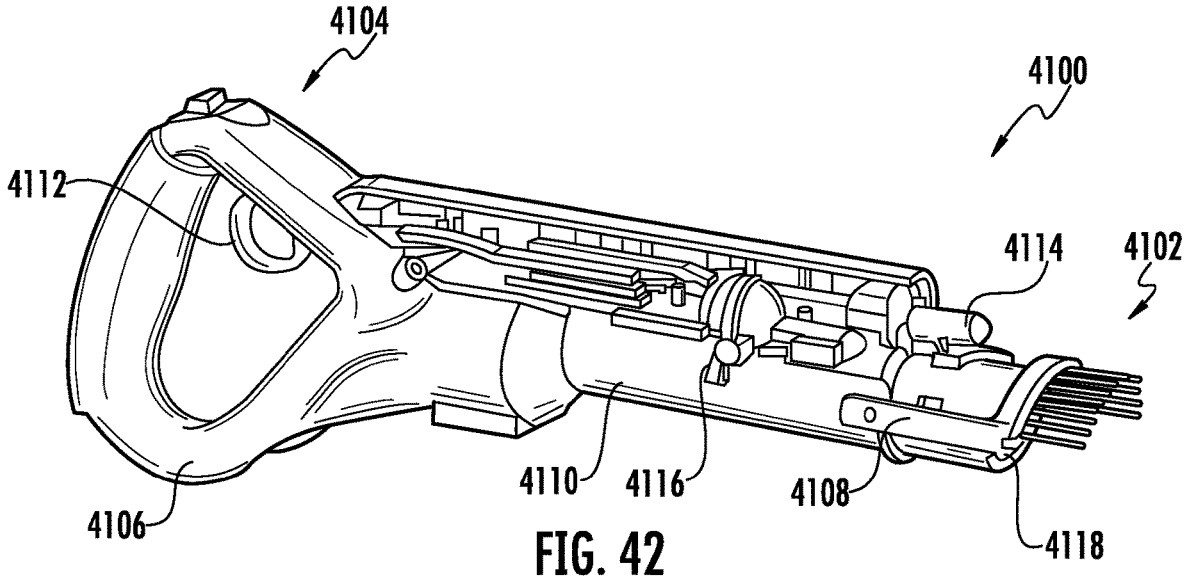
FIG. 42 is a perspective view of the handle assembly of FIG. 41 having the onboard accessory in a use state, consistent with embodiments of the present disclosure.

FIGS. 41 and 42 show a perspective view of a handle assembly 4100 configured to be used with a surface cleaning apparatus such as, for example, the surface cleaning apparatus 100 of FIG. 1. The handle assembly 4100 can include a coupling end 4102 configured to engage an accessory (e.g., any one of the accessories disclosed herein) and a handle end 4104 having a handle 4106. An onboard accessory 4108 can be pivotally coupled to a main body 4110 of the handle assembly 4100 such that the onboard accessory 4108 can transition between a stored state (e.g., as shown in FIG. 41) and a use state (e.g., as shown in FIG. 42). The onboard accessory 4108 can transition between the stored state and the use state in response to, for example, actuation of a toggle 4112. The toggle 4112 may also be configured to actuate an actuator 4114 that is configured to transition one or more of the accessories removably coupled at coupling end 4102 between operational states.

As shown, a catch 4116 is pivotally coupled to the main body 4110 such that actuation of the toggle 4112 causes the catch 4116 to pivot in response to movement of, for example, the actuator 4114. As the catch 4116 pivots, it moves out of engagement (e.g., contact) with a corresponding latch 4118 of the onboard accessory 4108. When the catch 4116 is moved out of engagement with the latch 4118 the onboard accessory 4108 is capable of pivoting from the stored state to the use state. In some instances, the onboard accessory 4108 may be biased towards to use state (e.g., using a spring).

Figure 43:
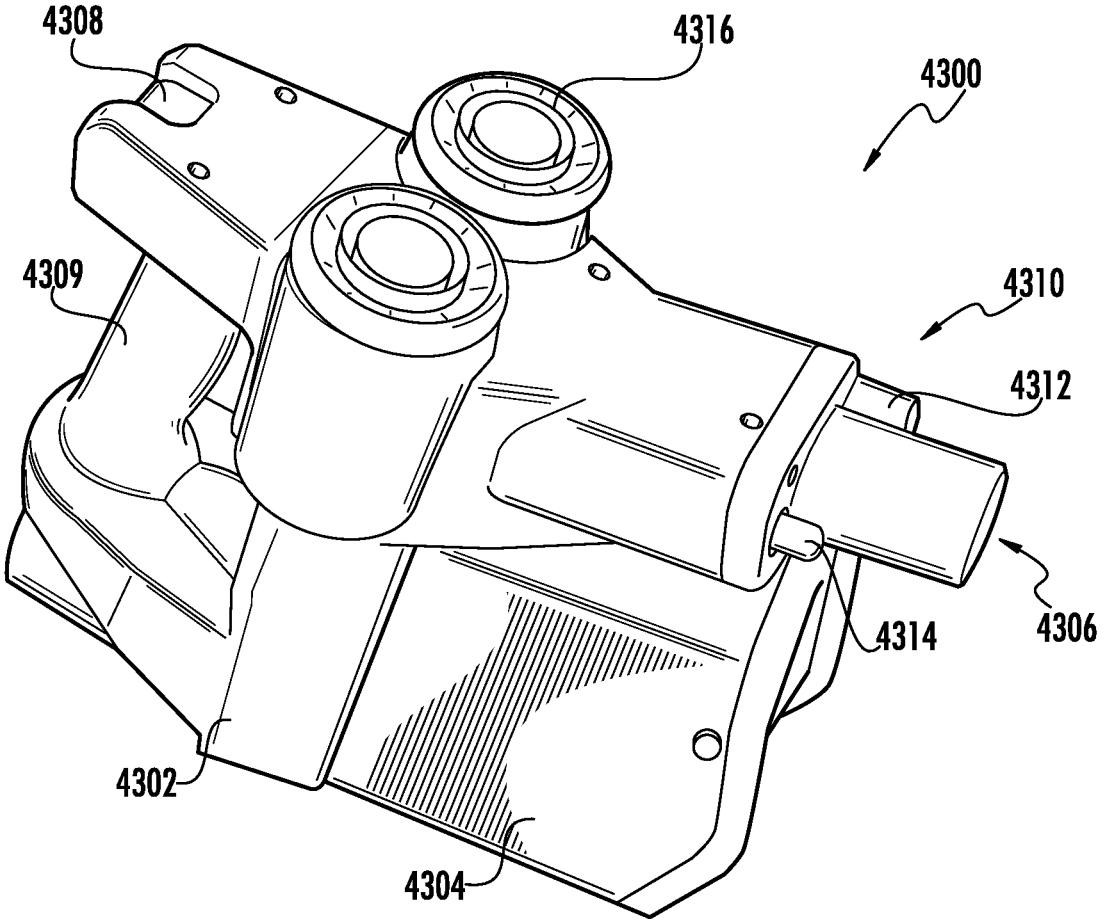
FIG. 43 is a perspective view of a handheld surface treatment apparatus, consistent with embodiments of the present disclosure.

FIG. 43 shows a perspective view of a handheld surface treatment apparatus 4300, which may be an example of the surface treatment apparatus 100 of FIG. 1. As shown, the handheld surface treatment apparatus 4300 includes a body 4302, a debris canister 4304 fluidly coupled to an air inlet 4306, and a toggle 4308 proximate a handle 4309. For purposes of clarity the toggle 4308 is illustrated as a depressible button, however, the toggle 4308 may also be, for example, a trigger configured to be pulled. A coupling 4310 is proximate the air inlet 4306 and configured to couple to one or more accessories (e.g., any one or more of the accessories disclosed herein). The coupling 4310 may include a power connector 4312 for providing power to one or more accessories coupled thereto and an actuator 4314 configured to cause accessory coupled thereto to transition between operational states. In some instances, the power connector 4312 and/or actuator 4314 may be separate from the coupling 4310 and may be positioned, for example, proximate the coupling 4310. The actuator 4314 is configured to move between an actuated and unactuated state in response to actuation of the toggle 4308. While the actuator 4314 and power connector 4312 are shown as being disposed on opposing sides of the coupling 4310, the actuator 4314 and power connector 4312 can be disposed at any location relative the coupling 4310.

The handheld surface treatment apparatus 4300 may also include one or more cyclonic separators 4316. The cyclonic separator 4316 is configured to separate at least a portion of debris from an airflow by cyclonic action.

Figure 44:
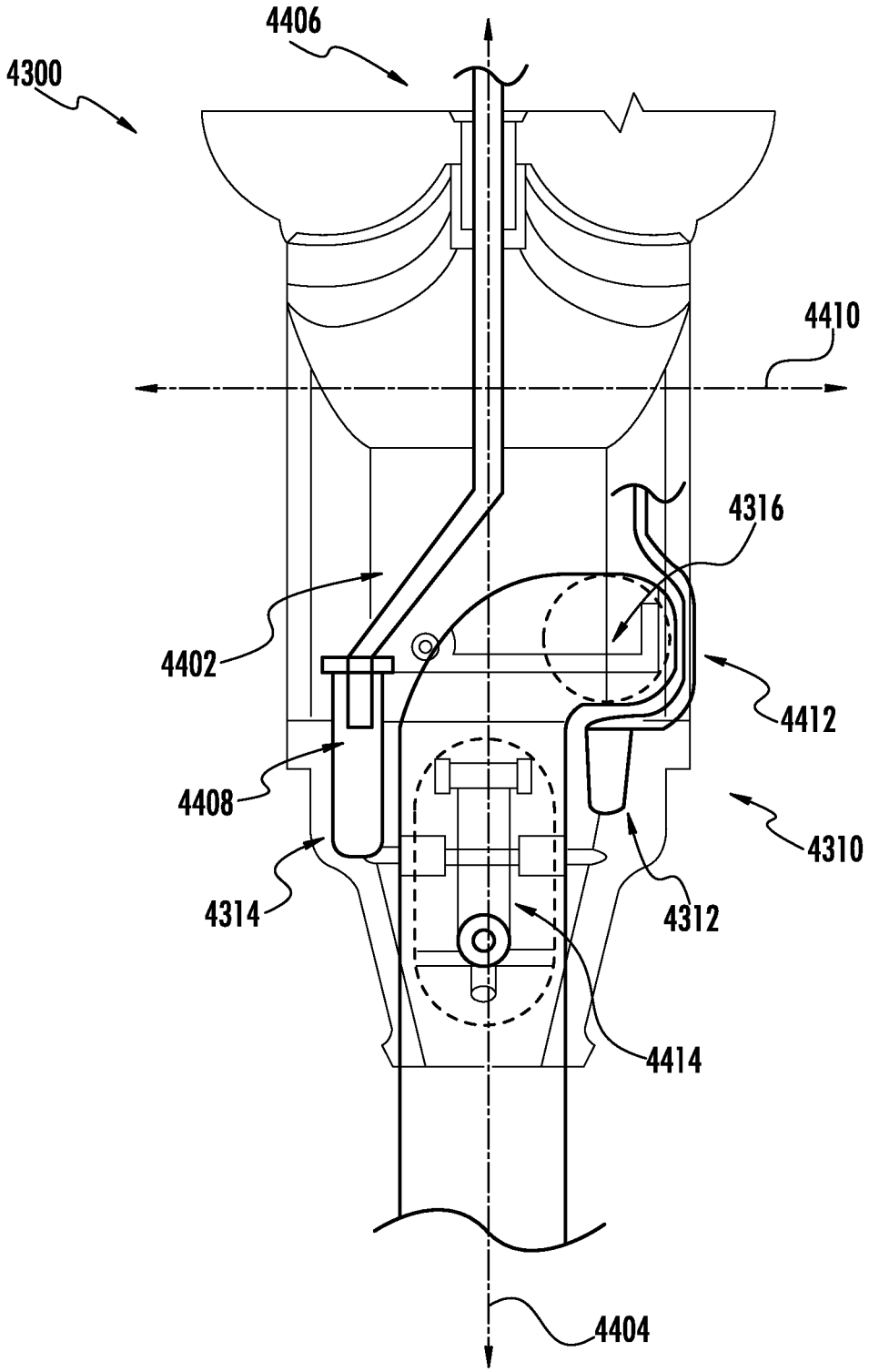
FIG. 44 is a schematic cross-sectional view of a portion of the handheld surface treatment apparatus of FIG. 43, consistent with embodiments of the present disclosure.

FIG. 44 is a schematic cross-sectional view of an example of the handheld surface treatment apparatus 4300 of FIG. 43. As shown, the actuator 4314 is urged between the actuated and unactuated states in response to movement of a push rod 4402 along a surface treatment apparatus longitudinal axis 4404. An input end 4406 of the push rod 4402 is proximate the toggle 4308 and an actuation end 4408 of the push rod 4402 is configured to engage (e.g., contact) the actuator 4314. As shown, the input end 4406 may be horizontally offset along a horizontal axis 4410 from the actuation end 4408 of the push rod 4402. The horizontal axis 4410 extends transverse to (e.g., perpendicular to) the surface treatment apparatus longitudinal axis 4404. The horizontal offset may allow the toggle 4308 to be centrally disposed relative to the surface treatment apparatus 4300 while the actuator 4314 can be non-centrally disposed relative to the surface treatment apparatus 4300.

As also shown, the power connector 4312 and the actuator 4314 can be disposed on opposing sides of the handheld surface treatment apparatus 4300. The power connector 4312 can be electrically coupled to a power supply (e.g., one or more batteries and/or an electrical grid) via power cables extending through a cable channel 4412. The cable channel 4412 can be configured to extend around at least one cyclonic separator 4316.

An accessory (e.g., any one of the accessories disclosed herein) can be coupled and decoupled from the coupling 4310 in response to actuation of a release 4414. The release 4414 may include a pivotal lever and a latch configured to releasably engage at least a portion of the coupling 4310.

Figure 45:
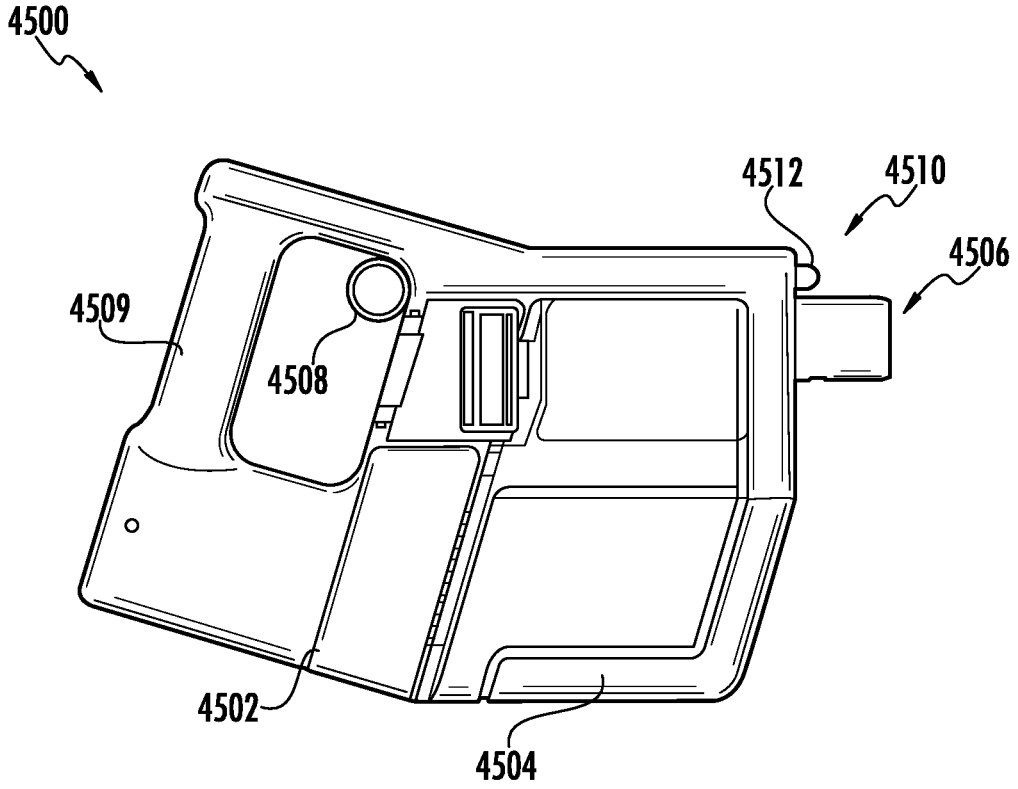
FIG. 45 is a sideview of a handheld surface treatment apparatus, consistent with embodiments of the present disclosure.

FIG. 45 shows a side view of a handheld surface treatment apparatus 4500, which may be an example of the surface treatment apparatus 100 of FIG. 1. As shown, the handheld surface treatment apparatus 4500 includes a body 4502, a debris canister 4504 fluidly coupled to an air inlet 4506, and a toggle 4508 (e.g., a pullable trigger) proximate a handle 4509. A coupling 4510 is proximate the air inlet 4506 and configured to couple to one or more accessories (e.g., any one or more of the accessories disclosed herein). The coupling 4510 may include an actuator 4512 configured to cause an accessory coupled thereto to transition between operational states. In some instances, the actuator 4512 may be separate from the coupling 4510 and may be positioned proximate the coupling 4510. The actuator 4512 is configured to move between an actuated and unactuated state in response to actuation of the toggle 4508.

Figure 46:
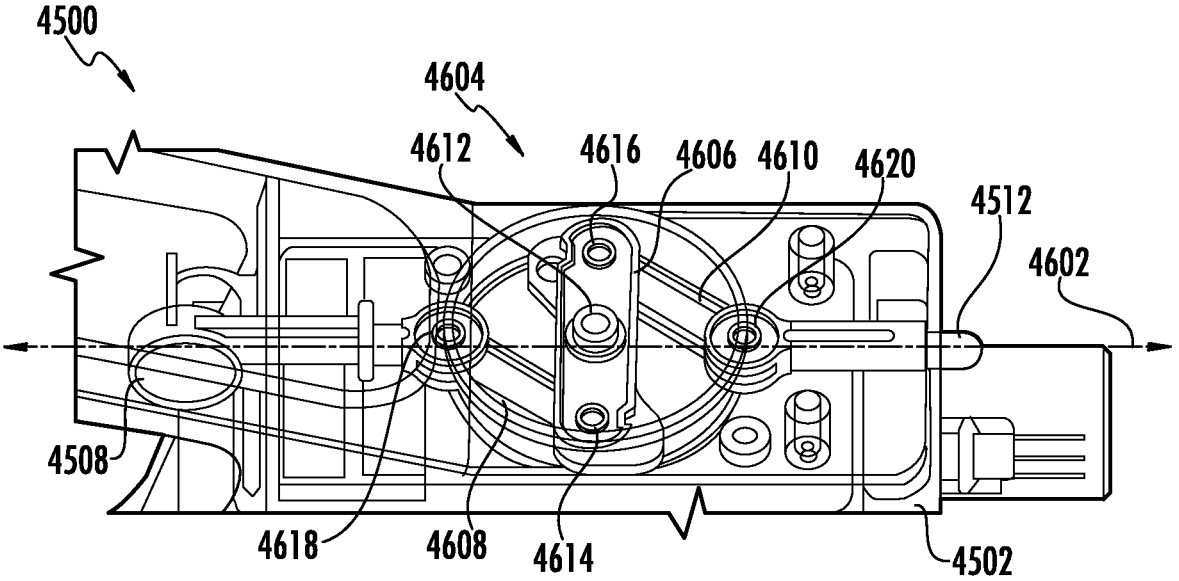
FIG. 46 is a magnified perspective view of a portion of the handheld surface treatment apparatus of FIG. 45 showing an example of a pivot linkage disposed therein, consistent with embodiments of the present disclosure.

FIG. 46 shows a magnified perspective view of a portion of the handheld surface treatment apparatus 4500 of FIG. 45. As shown, when the toggle 4508 is moved along a handheld surface treatment apparatus longitudinal axis 4602 a pivot linkage 4604 urges the actuator 4512 between actuated and unactuated states. The pivot linkage 4604 can be configured to urge the actuator 4512 in a direction opposite that of a direction that the toggle 4508 is urged. In other words, the actuator 4512 and toggle 4508 move in opposing directions along the handheld surface treatment apparatus longitudinal axis 4602.

As shown, the pivot linkage 4604 includes a pivot body 4606, a toggle arm 4608, and an actuator arm 4610. The pivot body 4606 is pivotally coupled to a portion of the body 4502 of the handheld surface treatment apparatus 4500 at a body pivot point 4612. The toggle arm 4608 is pivotally coupled to the pivot body 4606 at a toggle arm pivot point 4614 and the actuator arm 4610 is pivotally coupled to the pivot body 4606 at an actuator arm pivot point 4616. As shown, the toggle arm 4608 and the actuator arm 4610 are coupled at opposing ends of the pivot body 4606 such that the body pivot point 4612 is disposed between the toggle arm pivot point 4614 and the actuator arm pivot point 4616. The toggle arm 4608 is pivotally coupled to the toggle 4508 at a toggle pivot point 4618 and the actuator arm 4610 is pivotally coupled to the actuator 4512 at an actuator pivot point 4620. In some instances, the toggle pivot point 4618, the actuator pivot point 4620, and the body pivot point 4612 are aligned along a common axis.

In operation, when the toggle 4508 is urged rearwardly (e.g., in a direction of the user and/or the handle 4509), the toggle arm 4608 urges the pivot body 4606 to pivot such that the toggle arm pivot point 4614 moves along an arcuate path in a direction towards the user and/or the handle 4509 and the actuator arm pivot point 4616 moves along an arcuate path in a direction away from the user and/or handle 4509. As the actuator arm pivot point 4616 moves along an arcuate path in a direction away from the user and/or handle 4509, the actuator 4512 is urged in a direction away from the user and/or handle 4509 (e.g., towards the actuated state).

When the toggle 4508 is urged forwardly (e.g., in a direction away from the user and/or the handle 4509), the toggle arm 4608 urges the pivot body 4606 to pivot such that the toggle arm pivot point 4614 moves along an arcuate path in a direction away from the user and/or the handle 4509 and the actuator arm pivot point 4616 moves along an arcuate path in a direction towards the user and/or handle 4509. As the actuator arm pivot point 4616 moves along an arcuate path in a direction towards the user and/or handle 4509, the actuator 4512 is urged in a direction towards the user and/or handle 4509 (e.g., towards the unactuated state). In some instances, one or more of the toggle 4508, the pivot linkage 4604, and/or the actuator 4512 may engage and/or include a biasing mechanism that biases the actuator 4512 towards, for example, the unactuated state. The biasing mechanism may be, for example, a spring (e.g., a tension spring, a torsion spring, a compression spring, and/or any other suitable spring), an elastic material (e.g., a rubber), and/or any other suitable biasing mechanism.

Figure 47:
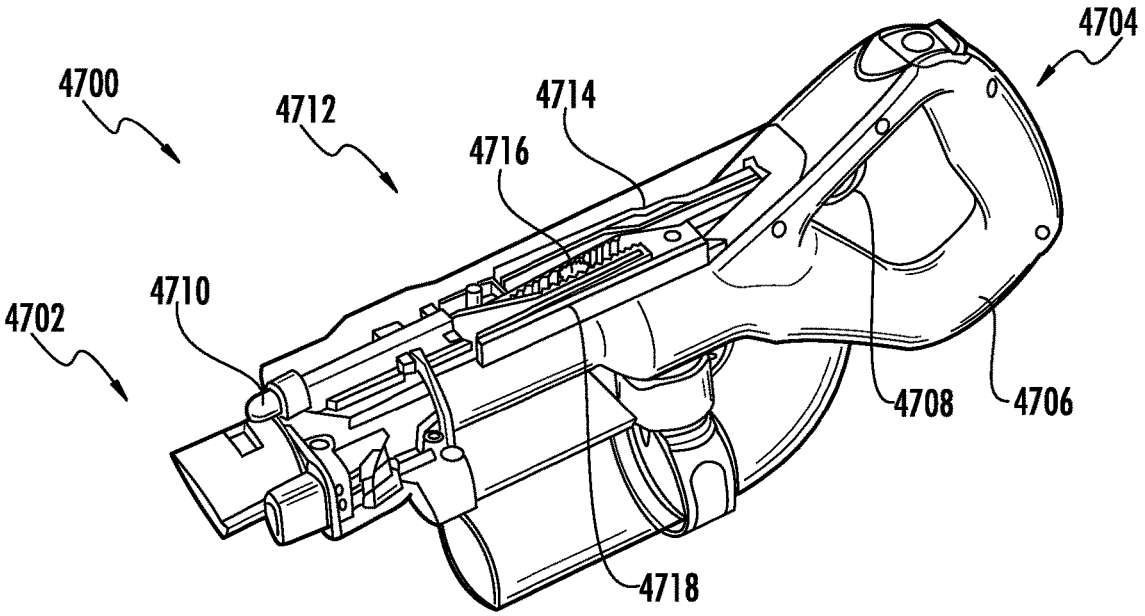
FIG. 47 is a perspective view of a handle assembly configured to be coupled to a surface treatment apparatus, the handle assembly having a rack-and-pinion configured to urge an actuator between an actuated state and an unactuated state, consistent with embodiments of the present disclosure.

FIG. 47 shows a perspective view of a handle assembly 4700 configured to be used with a surface cleaning apparatus such as, for example, the surface cleaning apparatus 100 of FIG. 1. The handle assembly 4700 can include a coupling end 4702 configured to engage an accessory (e.g., any one of the accessories disclosed herein) and a handle end 4704 having a handle 4706. A toggle 4708 can be disposed proximate the handle 4706 such that a user may actuate the toggle 4708. Actuation of the toggle 4708 causes an actuator 4710 to be transitioned between actuated and unactuated states. The actuator 4710 is configured to transition an accessory coupled to the handle assembly 4700 at the coupling end 4702 between operational states in response to the actuation of the toggle 4708.

Figure 48:
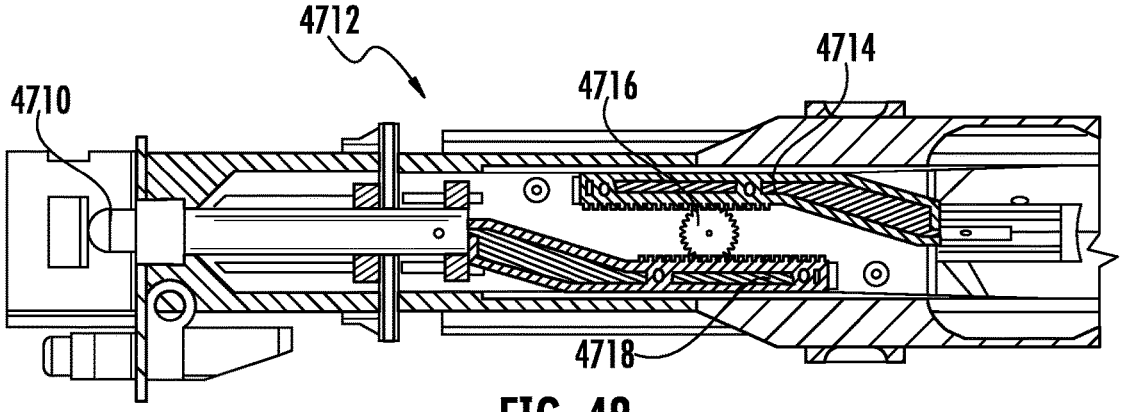
FIG. 48 is a cross-sectional view of a portion of the handle assembly of FIG. 47 showing the actuator in the unactuated state, consistent with embodiments of the present disclosure.
Figure 49:
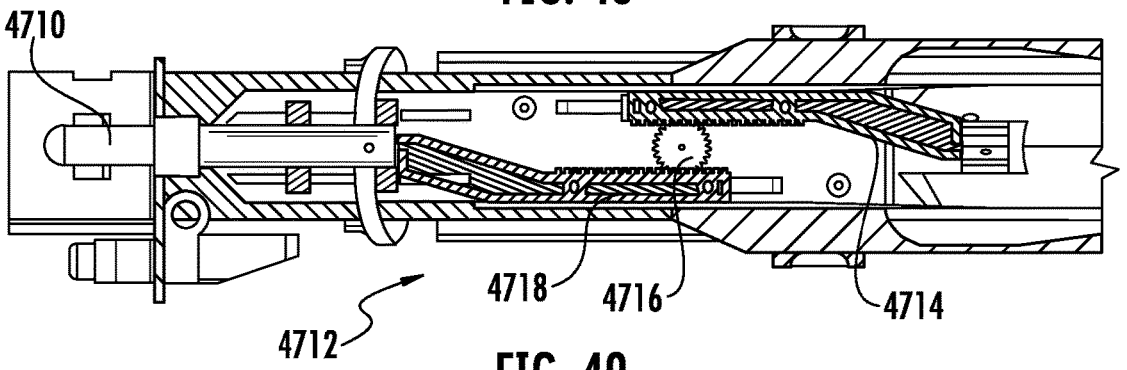
FIG. 49 is a cross-sectional view of a portion of the handle assembly of FIG. 47 showing the actuator in the actuated state, consistent with embodiments of the present disclosure.

As shown, the handle assembly 4700 includes a rack and pinion assembly 4712 configured to urge the actuator 4710 in a direction opposite that of a movement direction of the toggle 4708. The rack and pinion assembly 4712 includes a toggle rack 4714, a pinion 4716, and an actuator rack 4718. When the toggle 4708 is urged in a rearward direction (e.g., in a direction of a user and/or the handle 4706), the toggle rack 4714 is urged in a rearward direction causing the pinion 4716 to rotate such that the actuator rack 4718 is urged in a forward direction (e.g., in a direction away from the user and/or handle 4706). When the actuator rack 4718 is urged in the forward direction, the actuator 4710 is transitioned from an unactuated state (e.g., as shown in FIG. 48) towards an actuated state (e.g., as shown in FIG. 49). When the toggle is urged in a forward direction, the toggle rack 4714 is urged in a forward direction causing the pinion 4716 to rotate such that the actuator rack 4718 is urged in a rearward direction. When the actuator rack 4718 is urged in the rearward direction, the actuator 4710 is transitioned from an actuated state to an unactuated state. In some instances, one or more of the toggle 4708, the rack and pinion assembly 4712, and/or the actuator 4710 may engage and/or include a biasing mechanism that biases the actuator 4710 towards, for example, the unactuated state. The biasing mechanism may be, for example, a spring (e.g., a tension spring, a torsion spring, a compression spring, and/or any other suitable spring), an elastic material (e.g., a rubber), and/or any other suitable biasing mechanism.

Figure 51:
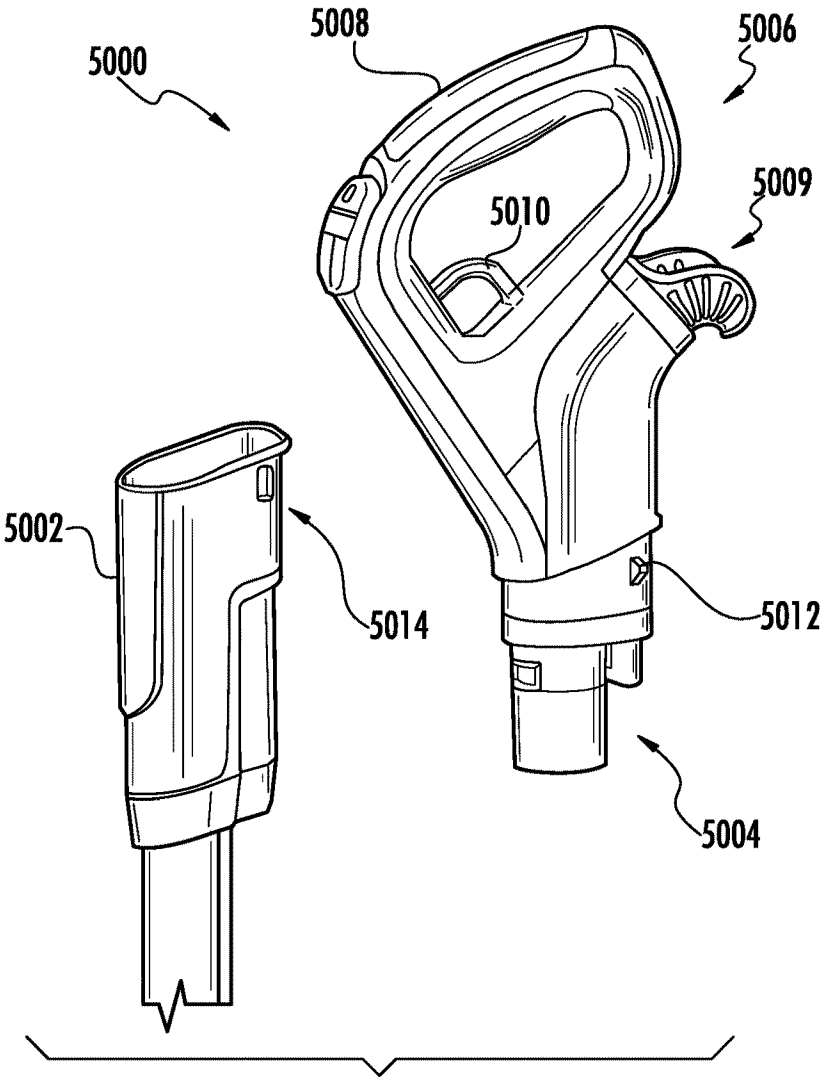
FIG. 51 shows a perspective view of the handle assembly of FIG. 50 decoupled from the accessory, consistent with embodiments of the present disclosure.
Figure 50:
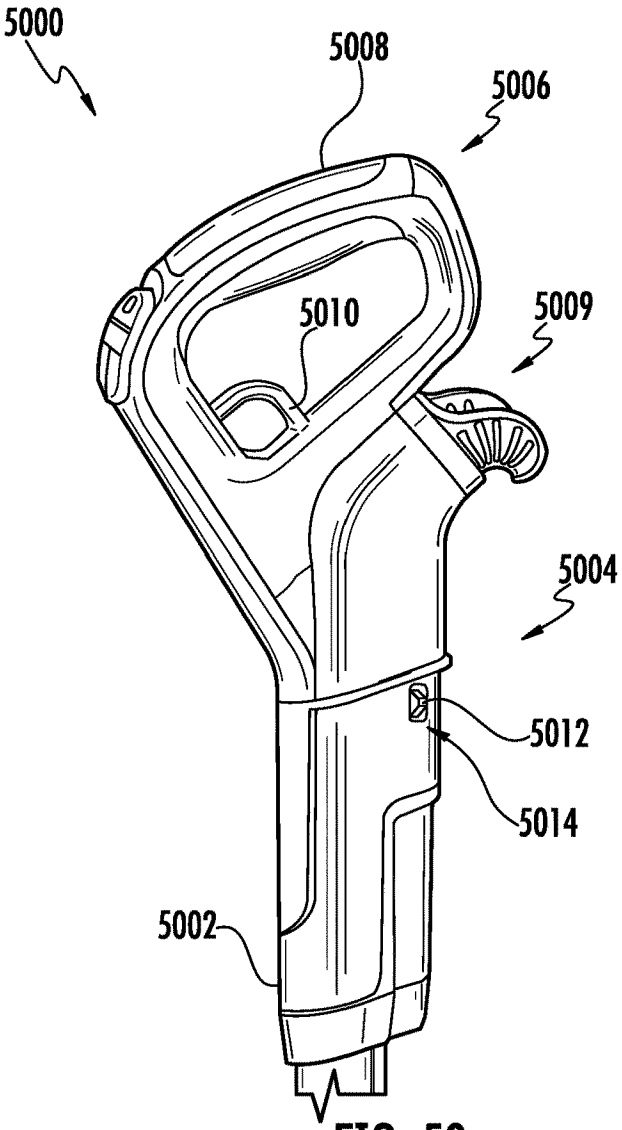
FIG. 50 shows a perspective view of a handle assembly configured to be fluidly coupled to a surface treatment apparatus, the handle assembly being removably coupled to an accessory, consistent with embodiments of the present disclosure.

FIG. 50 shows a perspective view of a handle assembly 5000 configured to be used with a surface cleaning apparatus such as, for example, the surface cleaning apparatus 100 of FIG. 1. The handle assembly 5000 is removably coupled to an accessory 5002, which may be an example of the accessory 110 of FIG. 1. As shown, the handle assembly 5000 can include a coupling end 5004 configured to releasably engage the accessory 5002, a handle end 5006 having a handle 5008, and an outlet 5009 configured to fluidly couple to a surface cleaning apparatus. A toggle 5010 can be disposed proximate the handle 5008. Actuation of the toggle 5010 can cause the accessory 5002 to transition between operation states. Additionally, or alternatively, in some instances, actuation of the toggle 5010 can actuate a latch 5012 configured to releasably couple the handle assembly 5000 to the accessory 5002 (e.g., as shown in FIG. 51).

As shown, the latch 5012 is configured to engage a catch 5014 defined in the accessory 5002. When actuated, the latch 5012 moves into or out of engagement with the catch 5014. When the latch 5012 moves out of engagement with the catch 5014, the handle assembly 5000 can be decoupled from the accessory 5002.

Figure 53:
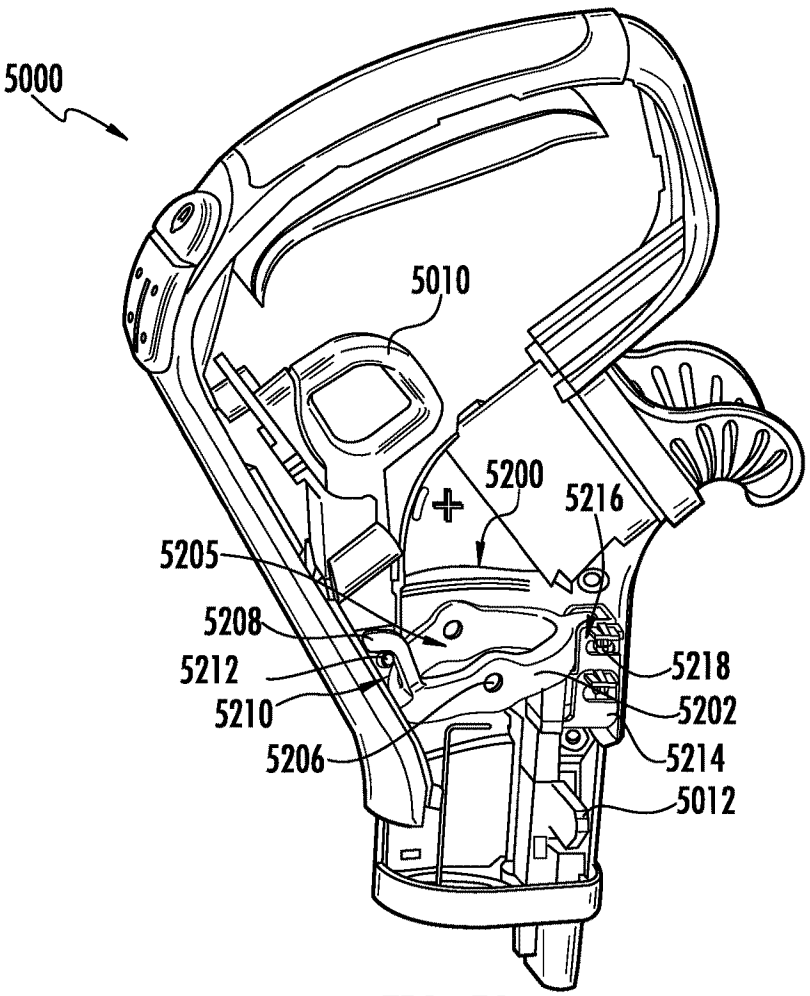
FIG. 53 shows another perspective view of the handle assembly of FIG. 50 having a portion removed therefrom to illustrate the pivot linkage, consistent with embodiments of the present disclosure.
Figure 52:
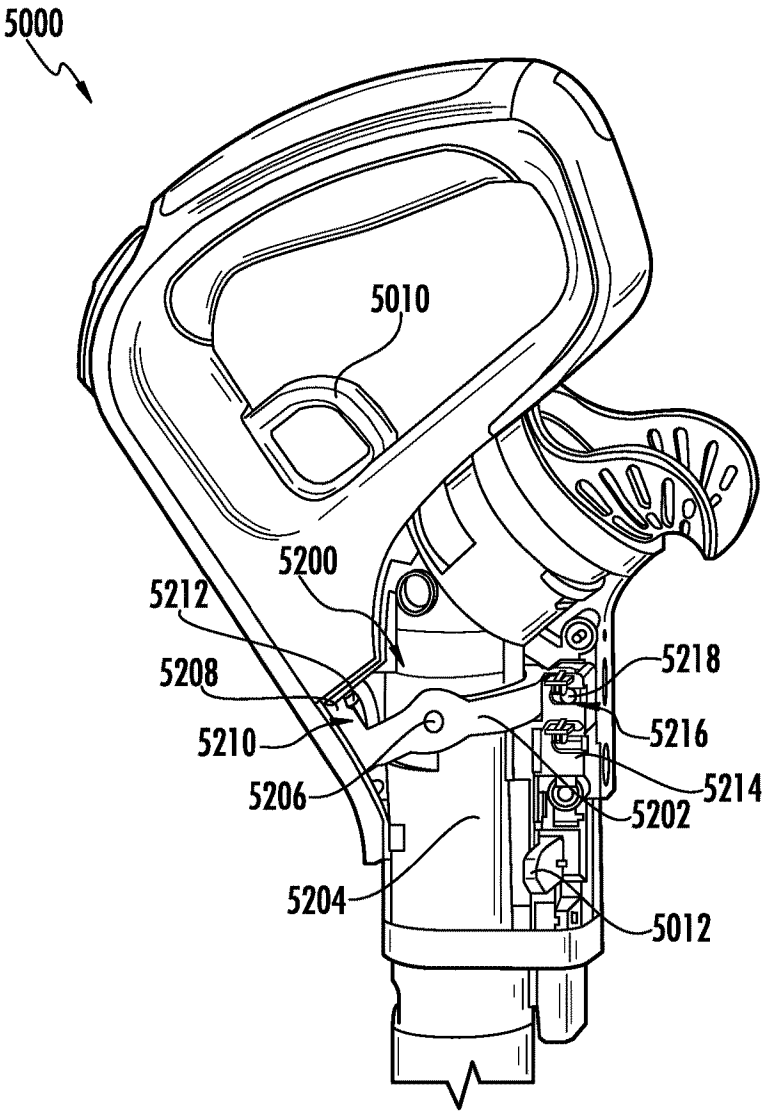
FIG. 52 shows a perspective view of the handle assembly of FIG. 50 having a portion removed therefrom to illustrate a pivot linkage configured to actuate an actuator, consistent with embodiments of the present disclosure.

FIGS. 52 and 53 show a perspective view of the handle assembly 5000 having portions removed therefrom for purposes illustrating a pivot linkage 5200. As shown, the pivot linkage 5200 includes a pivot body 5202 that is pivotally coupled to an air guide 5204 such that the pivot body 5202 pivots about a body pivot point 5206. The pivot body 5202 can extend, at least partially, around the air guide 5204. For example, the air guide 5204 can extend through an opening 5205 extending through the pivot body 5202.

The pivot body 5202 can be coupled to the toggle 5010 such that actuation of the toggle 5010 causes the pivot body 5202 to pivot about the body pivot point 5206. The pivot body 5202 can also be coupled to an actuator 5214 such that pivoting of the pivot body 5202 about the body pivot point 5206 causes the actuator 5214 to transition between actuated and unactuated states. As the actuator 5214 transitions towards the actuated state, the latch 5012 can be urged towards a delatched state (e.g., the latch 5012 comes out of engagement with the catch 5014). The toggle 5010 and the actuator 5214 can be coupled to opposing sides of the pivot body 5202 relative to a pivot axis defined by the body pivot point 5206.

As shown, the pivot body 5202 can include an arm 5208 that defines an arm slot 5210 that corresponds to at least one toggle protrusion 5212 extending from the toggle 5010. The toggle protrusion 5212 is configured to be able slide within the arm slot 5210. As such, the latch 5012 can be actuated without actuating the toggle 5010. The actuator 5214 can define an actuator slot 5216 configured to receive at least one corresponding body protrusion 5218. The body protrusion

5218 can be configured to slide within the actuator slot 5216. In some instances, one or more of the toggle 5010, the pivot linkage 5200, and/or the actuator 5214 may engage and/or include a biasing mechanism that biases the actuator 5214 towards, for example, the unactuated state. The biasing mechanism may be, for example, a spring (e.g., a tension spring, a torsion spring, a compression spring, and/or any other suitable spring), an elastic material (e.g., a rubber), and/or any other suitable biasing mechanism.

Figure 54:
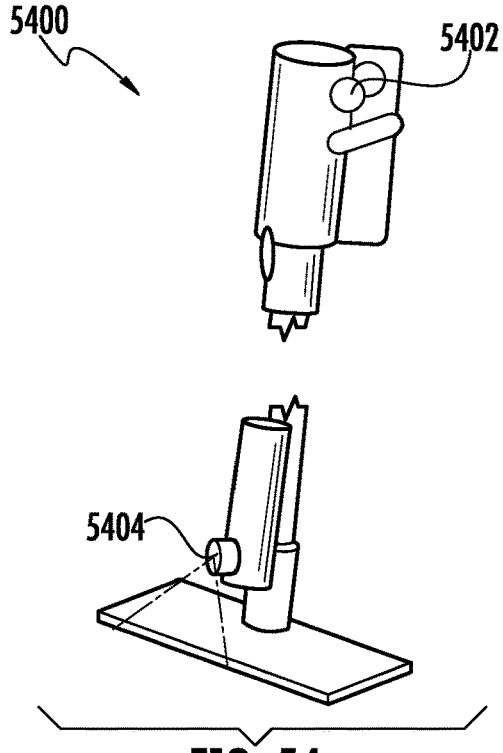
FIG. 54 shows a schematic perspective view of a surface treatment apparatus having a toggle configured to actuate one or more liquid pumps, consistent with embodiments of the present disclosure.
Figure 55:
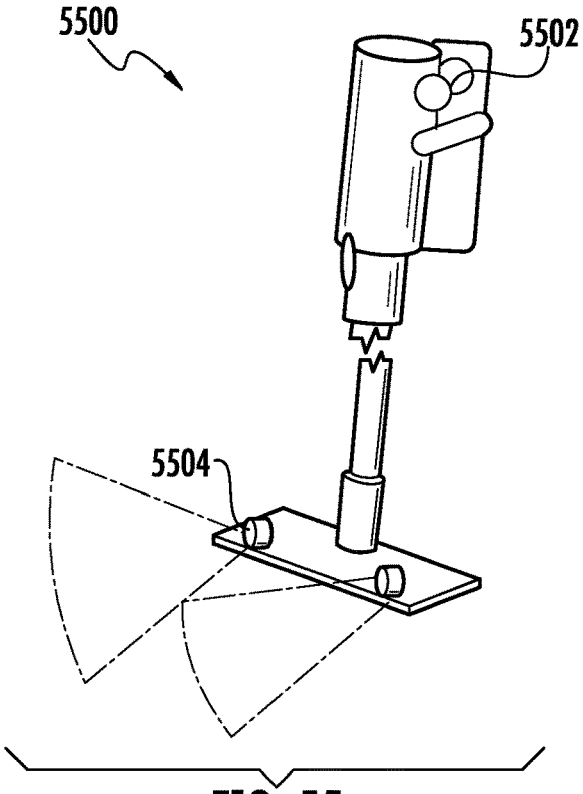
FIG. 55 shows a schematic perspective view of a surface treatments apparatus having a toggle configured to actuate one or more light emitters, consistent with embodiments of the present disclosure.

FIG. 54 shows a schematic view of an example of a surface cleaning apparatus 5400 having a toggle 5402 that actuates a pump 5404 for spraying a fluid (e.g., a cleaning solution or steam) onto a surface to be treated. The pump 5404 may be an electric pump or a manually driven pump (e.g., through the actuation of the toggle 5402). FIG. 55 shows a schematic view of an example of a surface cleaning apparatus 5500 having a toggle 5502 that actuates one or more lights 5504 (e.g., light emitting diodes or incandescent light bulb).

An example surface treatment apparatus may include a coupling, a handle, an accessory, and a toggle. The accessory can be coupled to the coupling and the accessory can have at least two operational states. The toggle can be proximate the handle, wherein actuation of the toggle causes the accessory to transition between operational states.

In some instances, the accessory may include a wand having a stand, wherein the stand is configured to transition between a stored state and a use state in response to the actuation of the toggle. A first end of the stand can be pivotally coupled to the wand. In some instances, the accessory may include a brush tool slideably coupled to a crevice tool, wherein the brush tool is configured to transition between a stored state and a use state in response to the actuation of the toggle. In some instances, the accessory may include a brush having a collar, wherein the collar is configured to slide along the brush between a first state and a second state in response to the actuation of the toggle. In some instances, the accessory includes a crevice tool, wherein the crevice tool is configured to expand from an unexpanded state to an expanded state in response to the actuation of the toggle. A width of the unexpanded state measures less than a width of the expanded state. In some instances, the toggle is one of a button or a trigger.

Another example of a handheld surface treatment apparatus may include a coupling, a handle, a toggle proximate the handle, a wand coupled to the coupling, and a surface cleaning head fluidly coupled to the wand. The wand may include a stand configured to be transitioned between a stored state and a use state in response to actuation of the toggle.

In some instances, a first end of the stand is pivotally coupled to the wand. In some instances, when the toggle is actuated, the stand pivots in a direction of a floor. In some instances, the handheld surface treatment apparatus includes a biasing mechanism configured to urge the stand from the use state to the stored state in response to the actuation of the toggle. In some instances, the toggle is one of a button or a trigger Another example of a handheld surface treatment apparatus may include a handle, a toggle proximate the handle, and an actuator. The actuator may be configured to cause an accessory having at least two operational states to transition between operational states in response to actuation of the toggle.

In some instances, the handheld surface treatment apparatus may include a coupling configured to couple to the accessory. In some instances, the accessory may include a wand having a stand. The stand may be configured to transition between a stored state and a use state in response to the actuation of the toggle. In some instances, a first end of the stand may be pivotally coupled to the wand. In some instances, the accessory may include a brush tool slideably coupled to a crevice tool. The brush tool may be configured to transition between a stored state and a use state in response to the actuation of the toggle. In some instances, the accessory includes a brush having a collar. The collar may be configured to slide along the brush between a first state and a second state in response to the actuation of the toggle. In some instances, the accessory includes a crevice tool. The crevice tool may be configured to expand from an unexpanded state to an expanded state in response to the actuation of the toggle. A width of the unexpanded state measures less than a width of the expanded state. In some instances, the toggle is one of a button or a trigger.

Each of the accessories described herein are merely examples to illustrate a toggle-actuated accessory having at least two operational states. Other example accessories capable of being actuated between operational states, include, but are not limited to, a telescopic wand, an accessory having a deployable brush/squeegee, and/or any other suitable accessory.

While the present disclosure has generally shown and described various accessories being coupled to a handheld surface cleaning apparatus, such a configuration is non-limiting. For example, the accessories described herein may be capable of being used with any one or more of a canister vacuum, an upright vacuum, a stick vacuum, and/or any other suitable surface cleaning apparatus.

Furthermore, the examples of how the operation of the toggle causes the accessory to transition between operational states are merely exemplary for the purposes of illustration and the present disclosure is not limited to the disclosed examples. Additionally, each of the described examples of the operation of the toggle operation can be readily applied to each of the accessories disclosed herein as well as other accessories having at least two operational states.

Further, while the actuation of the toggle has been described herein as mechanically causing an accessory to transition between operational states, the toggle may also be coupled to an electrical circuit that causes the accessory to transition between operational states. For example, an accessory may transition between operational states in response to the toggle causing a motor, an electric linear actuator, or other electric component to be actuated. In some instances, for example, the actuation of the toggle may cause a motor to induce vibrations into an accessory having a brush.

As used herein the term engage may generally refer to direct engagement (e.g., contact) and/or indirect engagement.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. It will be appreciated by a person skilled in the art that a vacuum attachment may embody any one or more of the features contained herein and that the features may be used in any particular combination or sub-combination. Modifications and substitutions by one of ordinary skill in the art are considered to be within the scope of the present invention, which is not to be limited except by the following claims.

What is claimed is:

1. A surface treatment apparatus comprising:

a vacuum chamber having a suction motor and a debris canister;

an inlet fluidly coupled to the vacuum chamber;

a coupling extending around at least a portion of the inlet;

a handle;

an accessory coupled to the coupling, the accessory having at least two operational states;

a toggle proximate the handle; and an actuator having an actuated state and an unactuated state, when in the unactuated state, the actuator is recessed relative to the coupling, and, when in the actuated state, the actuator extends from the coupling by an extension distance, the actuator being configured to cause the accessory to transition between the operational states in response to actuation of the toggle;

wherein the accessory includes a brush having a collar, the collar being configured to slide along the brush between a first state and a second state in response to the actuation of the toggle.

2. The surface treatment apparatus of claim 1, wherein the accessory includes a wand having a stand, the stand being configured to transition between a stored state and a use state in response to the actuation of the toggle.

3. The surface treatment apparatus of claim 2, wherein a first end of the stand is pivotally coupled to the wand.

4. The surface treatment apparatus of claim 1, wherein the accessory includes a brush tool slideably coupled to a crevice tool, the brush tool being configured to transition between a stored state and a use state in response to the actuation of the toggle.

5. The surface treatment apparatus of claim 1, wherein the accessory includes a crevice tool, the crevice tool being configured to expand from an unexpanded state to an expanded state in response to the actuation of the toggle, a width of the unexpanded state measuring less than a width of the expanded state.

6. The surface treatment apparatus of claim 1, wherein the toggle is one of a button or a trigger.

7. A handheld surface treatment apparatus comprising:

a vacuum chamber having a suction motor and a debris canister;

an inlet fluidly coupled to the vacuum chamber;

a coupling extending around at least a portion of the inlet;

a handle;

a toggle proximate the handle;

a wand coupled to the coupling, the wand including a stand configured to be transitioned between a stand stored state and a stand use state in response to actuation of the toggle, wherein a distal end of the stand includes an expanding foot configured to transition from a foot stored state to a foot use state in response to the stand transitioning from the stand stored state to the stand use state; and a surface cleaning head fluidly coupled to the wand.

8. The handheld surface treatment apparatus of claim 7, wherein, a first end of the stand is pivotally coupled to the wand.

9. The handheld surface treatment apparatus of claim 8, wherein, when the toggle is actuated, the stand pivots in a direction of a floor.

10. The handheld surface treatment apparatus of claim 9, further comprising a biasing mechanism, wherein the biasing mechanism urges the stand from the stand use state to the stand stored state in response to the actuation of the toggle.

11. The handheld surface treatment apparatus of claim 7, wherein the toggle is one of a button or a trigger.

12. A handheld surface treatment apparatus comprising:

a vacuum chamber having a suction motor and a debris canister;

a coupling extending around at least a portion of an inlet fluidly coupled to the vacuum chamber, the coupling being configured to couple to an accessory having at least two operational states;

a handle;

a toggle proximate the handle; and an actuator having an actuated state and an unactuated state, when in the unactuated state, the actuator extends from the coupling by a first extension distance, and, when in the actuated state, the actuator extends from the coupling by a second extension distance, the second extension distance being greater than the first extension distance, the actuator being configured to cause the accessory to transition between operational states in response to actuation of the toggle;

wherein the accessory includes a brush having a collar, the collar being configured to slide along the brush between a first state and a second state in response to the actuation of the toggle.

13. The handheld surface treatment apparatus of claim 12, wherein the accessory includes a wand having a stand, the stand being configured to transition between a stored state and a use state in response to the actuation of the toggle.

14. The handheld surface treatment apparatus of claim 13, wherein a first end of the stand is pivotally coupled to the wand.

15. The handheld surface treatment apparatus of claim 12, wherein the accessory includes a brush tool slideably coupled to a crevice tool, the brush tool being configured to transition between a stored state and a use state in response to the actuation of the toggle.

16. The handheld surface treatment apparatus of claim 12, wherein the accessory includes a crevice tool, the crevice tool being configured to expand from an unexpanded state to an expanded state in response to the actuation of the toggle, a width of the unexpanded state measuring less than a width of the expanded state.

17. The handheld surface treatment apparatus of claim 12, wherein the toggle is one of a button or a trigger.

* * * * *